US007856787B2

(12) United States Patent
Fujihashi et al.

(10) Patent No.: US 7,856,787 B2
(45) Date of Patent: Dec. 28, 2010

(54) JOINT FITTING BETWEEN MEMBERS AND JOINT STRUCTURE AND JOINING METHOD OF UPPER AND LOWER FLOOR VERTICAL FRAME MEMBERS

(75) Inventors: Kazunori Fujihashi, Tokyo (JP); Yoshimichi Kawai, Futtsu (JP); Shigeaki Tohnai, Tokyo (JP); Hiroshi Tanaka, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 929 days.

(21) Appl. No.: 10/559,041

(22) PCT Filed: Sep. 5, 2005

(86) PCT No.: PCT/JP2005/016676

§ 371 (c)(1),
(2), (4) Date: Nov. 29, 2005

(87) PCT Pub. No.: WO01/50462

PCT Pub. Date: Jul. 12, 2001

(65) Prior Publication Data

US 2007/0110513 A1 May 17, 2007

(30) Foreign Application Priority Data

Nov. 25, 2004 (JP) ..... 2004-340021
Aug. 8, 2005 (JP) ..... 2005-229253

(51) Int. Cl.
*E04B 5/18* (2006.01)

(52) U.S. Cl. ..... 52/698; 52/703; 52/745.21; 52/223.14; 52/92.2

(58) Field of Classification Search ..... 52/293.3, 52/295, 223.13, 223.14, 127.5, 240, 296, 52/745.09, 712, 719, 92.1, 93.1, 92.2, 745.21, 52/291, 272, 167.1, 698, 236.3; 403/109.5, 403/374.1–374.4, 408.1, 409.1
See application file for complete search history.

(56) References Cited

U.S. PATENT DOCUMENTS 2,625,815 A * 1/1953 Black ..... 52/126.1
4,875,314 A * 10/1989 Boilen ..... 52/167.1
5,092,097 A * 3/1992 Young ..... 52/702

(Continued)

FOREIGN PATENT DOCUMENTS

JP 57-34415 7/1982

(Continued)

*Primary Examiner*—Robert J Canfield
*Assistant Examiner*—Babajide Demuren
(74) *Attorney, Agent, or Firm*—Kenyon & Kenyon LLP

(57) ABSTRACT

A joint fitting 1 between members comprising a single bolt 4 having a length enabling it to be arranged vertically oriented bridging an upper floor vertical frame member and a lower floor vertical frame member at intervals along the axial direction. Joint hardware 7 is fastened to vertical frame members of the floors arranged at the upper floor side and lower floor side. Side opening grooves in the joint hardware 7 detachable receive the bolt. The attached joint hardware 7 is able to be fastened positioned along the longitudinal direction of the bolt 4. The joint hardware 7 is arranged at the upper and lower floors with the joint hardware being butted against vertical side surfaces of the vertical frame members 11 of the floors and fastened by drill screws 24 or other fasteners.

14 Claims, 22 Drawing Sheets

U.S. PATENT DOCUMENTS

| | | | | | |
|---|---|---|---|---|---|
| 6,014,843 | A * | 1/2000 | Crumley et al. | 52/167.3 |
| 6,158,188 | A * | 12/2000 | Shahnazarian | 52/702 |
| 6,453,634 | B1 * | 9/2002 | Pryor | 52/713 |
| 6,550,200 | B1 * | 4/2003 | Mueller | 52/296 |
| 6,625,945 | B2 * | 9/2003 | Commins | 52/293.3 |
| 6,715,258 | B1 * | 4/2004 | Mueller | 52/745.12 |
| 6,920,724 | B1 * | 7/2005 | Hundley | 52/167.3 |
| 7,117,648 | B1 * | 10/2006 | Pryor | 52/291 |
| 7,124,550 | B1 * | 10/2006 | Deming | 52/745.21 |
| 2006/0021291 | A1 * | 2/2006 | Leek et al. | 52/293.3 |

FOREIGN PATENT DOCUMENTS

| | | | |
|---|---|---|---|
| JP | 10-311110 | | 11/1998 |
| JP | 10311110 | A * | 11/1998 |
| JP | 2602054 | | 12/1999 |
| JP | 3088396 | | 9/2002 |
| JP | 2002-294869 | | 10/2002 |
| JP | 2003227174 | A * | 8/2003 |

* cited by examiner

JOINT FITTING BETWEEN MEMBERS AND JOINT STRUCTURE AND JOINING METHOD OF UPPER AND LOWER FLOOR VERTICAL FRAME MEMBERS

TECHNICAL FIELD

The present invention relates to a joint fitting between members connecting vertical frame members, horizontal frame members, floor joints, or roof truss chord members, and other members adjoining each other directly or spaced apart at upper and lower floors of buildings, in particular steel house structures, and to a joint structure and joining method of upper and lower floor vertical frame members using that joint fitting between members.

BACKGROUND ART

In the past, when connecting a vertical frame stud in an upper floor wall panel etc. and a vertical frame stud in a lower floor wall panel etc., a structure using joint hardware comprised of three pieces of hardware consisting of two pieces of hold down hardware and a set of a connection bolt and nuts, fastening the hold down hardware to the vertical frame stud in the upper floor wall panel, fastening the hold down hardware to the vertical frame stud in the lower floor wall panel, and connecting these hold down hardware by the bolt and nut connection hardware.

In a joint structure using joint hardware comprising such three types of hardware, when an earthquake or wind causes a horizontal force to act on the structure, since only tensile force can be transmitted, the compressive force is transmitted by the floor assembly parts. This requires complicated measures such as insertion of compression reinforcing hardware inside the floor assembly sandwiched between the vertical frame studs of the upper and lower floor wall panels, increases the number of pieces, and complicates the design and installation.

Further, as shown in FIG. 22 and FIG. 23, there is also known a joint structure of a type providing, instead of compression reinforcing hardware separately arranged inside the floor assembly, flanges 26 at the top and bottom of a cylindrical body 25 comprised of a steel pipe to form a flanged cylindrical body 27, arranging a connection bolt 28 inside the flanged cylindrical body 27, and connecting upper and lower hold down hardware 30 and 31 to the connection bolt 28 by threaded nuts 29 (for example, see Japanese Patent Publication (a) No. 10-311110).

DISCLOSURE OF THE INVENTION

In the prior art, in each case, three separate types of hardware with large rigidity for transmitting stress including two pieces of hold down hardware 30 and 31, a set of a connection bolt and nuts 28 and 29, and compression reinforcing hardware or its equivalent flanged cylindrical body 27 are required. The number of pieces of hardware becomes greater, the structure becomes complicated, and the hold down hardware 30 and 31 have to be arranged at the upper and lower floor sides. Further, the hold down hardware 30 and 31 of these upper and lower floors become offset, so the through holes for these bolts are made larger to enable the connection bolt 28 to be positioned. Therefore, the horizontal direction distance L from the joint part between the hold down hardware 30 and 31 and the vertical frame members to the center axis C of the connection bolt becomes larger, hold down hardware 30 and 31 with large bending rigidity are required, and the installation is complicated and at high cost. Further, there is the problem that insertion of the flanged cylindrical body 27 into the floor assembly 32 requires a high level of installation ability.

Further, a simple structure joint fitting able to transmit the stress of both compressive force and tensile force no matter what direction, that is, the vertical direction or horizontal direction or an inclined direction, arranged in has been desired.

The present invention has as its object the provision of a joint fitting between members with a simple structure able to simplify the joint structure and able to transmit the stress of both compressive force and tensile force and a joint structure and method of joining enabling easy installation with a simple structure using the joint fitting.

To advantageously solve the above problem, there is provided a joint fitting between members of a first aspect of the invention characterized by comprising a single bolt having a predetermined length at intervals along the axial direction of which joint hardware to be fastened to separate members and having side opening groove cross-sections are arranged, the side opening grooves in the joint hardware being able to detachably receive the bolt, and the joint hardware being attached to be able to be fastened in position along the longitudinal direction of the bolt.

Further, there is provided a joint fitting between members of a second aspect of the invention, comprising a single bolt having a length enabling it to be arranged vertically oriented bridging an upper floor vertical frame member and a lower floor vertical frame member at intervals along the axial direction of which bolt joint hardware to be fastened to vertical frame members of the floors arranged at the upper floor side and lower floor side and having side opening groove cross-sections are arranged, the side opening grooves in the joint hardware being able to detachably receive the bolt, and the joint hardware being attached to be able to be fastened in position along the longitudinal direction of the bolt.

Further, there is provided a third aspect of the invention comprised of the joint fitting between members of the first or second aspect of the invention characterized in that the joint hardware are arranged to be able to be adjusted in position in the longitudinal direction of the bolt.

Further, there is provided a fourth aspect of the invention comprised of the joint fitting between members of any of the first to third aspects of the invention characterized in that the joint hardware with the side opening groove cross-sections are made cross-sectional hat shapes having joint flanges at the two sides in the horizontal direction and in that the grooves of the joint hardware can receive the bolt shaft.

Further, there is provided a fifth aspect of the invention comprised of any of the first aspect of the invention to the fourth aspect of the invention characterized in that the grooves of the joint hardware have side opening widths made slightly smaller than the outside diameter dimension of the bolt shaft.

Further, there is provided a sixth aspect of the invention comprising any of the first aspect of the invention to the fifth aspect of the invention characterized in that the joint hardware are formed into cross-sectional side opening groove shapes by bending steel sheet.

Further, there is provided a seventh aspect of the invention comprising any of the first aspect of the invention to the sixth aspect of the invention characterized in that the joint hardware are provided above and below them with female thread fittings screwed over the bolt, the upper and lower female thread fittings clamping the joint hardware between them to hold the joint hardware at predetermined positions of the longitudinal direction of the bolts.

Further, there is provided an eighth aspect of the invention comprised of a joint fitting between members of the seventh aspect of the invention characterized in that the joint hardware and the female thread fittings have interposed between them at least one washer passing over the bolt.

Further, there is provided a ninth aspect of the invention comprised of a joint fitting between members of an eighth aspect of the invention characterized in that each washer is a U-cross-section washer having legs arranged in proximity to or in contact with two side plates of joint hardware.

Further, there is provided a 10th aspect of the invention comprised of a joint fitting between members of an eighth aspect of the invention characterized in that the washers include a U-cross-section washer having legs arranged in proximity to or in contact with two side plates of joint hardware and a flat washer interposed between the U-cross-section washer and a female thread fitting.

Further, there is provided an 11th aspect of the invention comprised of any of the seventh aspect of the invention to the 10th aspect of the invention characterized in that the female thread fittings are nuts.

Further, there is provided a 12th aspect of the invention comprised of any one of the seventh aspect of the invention to 11th aspect of the invention characterized in that the grooves of the joint hardware receive the bolt so that its outer circumference is contacted.

Further, there is provided a joint structure between adjoining members of a building in a 13th aspect of the invention characterized in that a joint fitting between members of any of the first aspect of the invention to the 12th aspect of the invention is used to join adjoining horizontal members, floor joists, roof truss chord members, or other adjoining members in the building.

Further, there is provided a joint structure of upper and lower floor vertical frame members of a 14th aspect of the invention characterized in that joint hardware in the joint fitting between members of any of the first aspect of the invention to the 12th aspect of the invention are butted against the vertical side faces of the vertical frame members of the different floors and are fastened there by fastening devices comprised of drill screws, bolts, or other fasteners provided horizontally oriented bridging the joint hardware and vertical frame members.

Further, there is provided a method of joining members of a 15th aspect of the invention characterized by comprising constructing a joint structure of the 13th aspect of the invention or 14th aspect of the invention during which butting one joint hardware among the joint hardware in a joint fitting between members of any one of the first aspect of the invention to the 12th aspect of the invention against one member to be joined, fastening it by providing fastening devices comprised of drill screws, bolts, or other fasteners bridging the joint hardware and the member to be joined, then butting the other joint hardware against the other member to be joined and fastening it by providing fastening devices comprised of drill screws, bolts, or other fasteners.

Further, there is provided a method of joining upper and lower floor vertical frame members of a 16th aspect of the invention characterized by comprising constructing a joint structure of the 13th aspect of the invention or 14th aspect of the invention during which butting one joint hardware among the joint hardware arranged bridging upper and lower floors in a joint fitting between members of any one of the first aspect of the invention to the 12th aspect of the invention against a vertical side face of a vertical frame member of one of the upper and lower floor, fastening it by providing fastening devices comprised of drill screws, bolts, or other fasteners bridging horizontally oriented the joint hardware and the vertical frame member, then butting the other joint hardware against the vertical side face of the vertical frame member at the other floor and fastening it by providing fastening devices comprised of drill screws, bolts, or other fasteners horizontally oriented.

Further, there is provided a method of joining upper and lower floor vertical frame members of a 17th aspect of the invention characterized by comprising constructing a joint structure of the 13th aspect of the invention or 14th aspect of the invention during which attaching to the bolt of the joint fitting between members of any of the first aspect of the invention to the 12th aspect of the invention at least one female threaded fitting to be arranged at the upper floor side, arranging the bolt from the upper floor side to the lower floor side in a state using that female threaded fitting to prevent the bolt from dropping to the lower floor side, then attaching the other female thread fittings to the bolt, then fitting the joint hardware of the different floors over the bolt, then butting the joint hardware against the vertical side faces of the vertical frame members and fastening them by providing fastening devices comprised of drill screws, bolts, or other fasteners bridging horizontally oriented.

According to the first aspect of the invention, it is possible to obtain a joint fitting between members of a simple structure comprised of a seamless single bolt of a predetermined length able to be arranged bridging separate members at the two ends of the axial direction of which are provided joint hardware attached in a manner enabling fastening in position and possible to obtain a joint fitting between members of a simple structure enabling transmission of stress of both compressive force and tensile force.

Further, the bolt is detachably fit into side opening grooves of the joint hardware, so the joint hardware can be moved in the horizontal direction from the side face of the bolt for easy attachment when attaching them to the bolt, so assembly is easy when assembling the joint fitting between members or fitting the joint hardware to the bolt and the installation efficiency can be improved.

Further, the side opening grooves can receive the bolt inside them, so the offset between the members to be joined and the bolt center axis can be reduced, the bending stress acting on the joint fitting between members can be reduced, and the thickness of the joint hardware having the side opening grooves can be made thinner and more economic joint hardware can be obtained.

According to the second aspect of the invention, it is possible to obtain a joint fitting between members of a simple structure comprised of a seamless single bolt of a predetermined length able to be arranged bridging an upper floor vertical frame member and a lower floor vertical frame member at the two ends of the axial direction of which are provided joint hardware attached in a manner enabling fastening in position and possible to obtain a joint fitting between members of a simple structure enabling transmission of stress of both compressive force and tensile force.

Further, the bolt is detachably fit into side opening grooves of the joint hardware, so the joint hardware can be moved in the horizontal direction from the side face of the bolt for easy attachment when attaching them to the bolt, so assembly is easy when assembling the joint fitting between members or fitting the upper and lower floor joint hardware to the bolt and the installation efficiency can be improved.

Further, the side opening grooves can receive the bolt inside them, so the offset between the upper and lower vertical frame members and the bolt center axis can be reduced, the bending stress acting on the joint fitting between members can be reduced, and the thickness of the joint hardware having the side opening grooves can be made thinner and more economic joint hardware can be obtained.

According to the third aspect of the invention, the joint hardware are arranged in a manner enabling adjustment of position in the longitudinal direction of the bolt, whereby it is possible to adjust the positions of the joint hardware in the vertical direction of the bolt to predetermined positions of the upper and lower floor vertical frame members and fasten them in position there for fastening to the vertical frame members.

According to the fourth aspect of the invention, it is possible to arrange the bolt shaft in the grooves of the joint hardware, possible to utilizing joint flanges to easily fasten the hardware to the vertical frame members of the different floors, possible to arrange the bolt shaft in the grooves of the joint hardware and thereby reduce the offset between the mounts of the vertical frame members and the axial center of the bolt, and possible to reduce the bending force acting on the joint hardware, so possible to obtain economical joint hardware with thin joint hardware thicknesses.

According to the fifth aspect of the invention, the grooves of the joint hardware have side opening widths slightly smaller than the outside diameter dimension of the bolt shaft, so it is possible to press fit the joint hardware over the bolt shaft from the side openings for engagement, then prevent the joint fittings from detaching from the bolt shaft.

According to the sixth aspect of the invention, it is possible to economically fabricate the joint hardware with the side opening groove cross-sectional shapes by bending inexpensive steel sheet. For this reason, it is possible to obtain inexpensive joint fittings between members.

According to the seventh aspect of the invention, it is possible to use the female thread fittings arranged above and below the joint hardware to easily fasten the joint hardware at predetermined positions in the axial direction of the bolt. Further, it is possible to transmit tensile force or compressive force through the female thread fittings to the bolt.

Further, according to the eighth aspect of the invention, the joint hardware and female thread fittings have at least one washer interposed between them, so the nuts and other female thread fittings are not directly butted against the ends of the joint hardware. Further, the female thread fittings do not directly exert pressure while being turned, so the pressing force from the female thread fittings is dispersed and transmitted to the joint hardware by the washer. Further, since the female thread fittings do not directly contact the joint hardware, when turning the female thread fittings by turning tools and pressing and holding the joint hardware through the washers, the female thread fittings will not butt against the side plates of the joint hardware, so the torsional moment acting on side plates of the joint hardware due to turning of the female thread fittings can be reduced and opening of the side plates to the outside can be reduced.

Further, according to the ninth aspect of the invention, the washers used butting against the joint hardware are U-cross-section washers and the legs of the U-cross-section washers are in proximity to or butt against the outsides of the side plates of the joint hardware, so even if the female thread fittings are turned so as to fasten the joint hardware in position, engagement of the side plates with the legs can positively prevent opening of the side plates in the joint hardware.

Further, according to the 10th aspect of the invention, two washers, that is, a flat washer and a U-cross-section washer having legs, are used, so the flat washer enables the pressing force of the female thread fittings to be uniformly dispersed and transmitted to the U-cross-section washer and further the U-cross-section washer enables the pressing force from the flat washer to be uniformly dispersed and transmitted to the joint hardware and the legs in the U-cross-section washer enable opening of the side plates of the joint hardware to be reliably prevented.

According to the 11th aspect of the invention, the female thread fittings can be made inexpensive nuts and the joint hardware can be fastened at predetermined positions in the axial direction of the bolts.

According to the 12th aspect of the invention, the outer circumference of the bolt shaft contacts the grooves of the joint hardware, so it is possible to prevent relative offset of the center axis of the bolt and center axis of the grooves of the joint hardware in the horizontal direction and possible to obtain a good precision joint fitting between members.

According to the 13th aspect of the invention, it is possible to join adjoining horizontal members, floor joists, roof truss chord members, and other adjoining members in a building using a joint fitting between members of a simple structure, so the connected joint structure between members becomes simple in structure and installation becomes easy. Further, a joint structure able to reliably transmit compressive force and tensile force can be obtained. Further, arrangement in a suitable direction such as the vertical direction, horizontal direction, inclined direction, etc. is possible, so the general usability is high.

According to the 14th aspect of the invention, it is possible to butt the joint hardware in the joint fitting between members against the vertical side faces of the vertical frame members of the different floors and fasten them there by fastening devices comprised of drill screws, bolts, and other fasteners in the horizontal direction so as to transmit vertical direction compressive force and tensile force through the joint fitting between members and the fastening devices comprised of the drill screws and other fasteners.

According to the 15th aspect of the invention, one joint hardware of the joint hardware in the joint fitting between members is butted against one member to be joined and fastened there by providing fastening devices comprised of drill screws, bolts, or other fasteners bridging the joint hardware and the member to be joined, then the other joint hardware is butted against the other member to be joined and fastened by providing fastening devices comprised of drill screws or bolts or other fasteners, so it is possible to use a simple structure joint fitting between members and easily join the joint hardware in the joint fitting using drill screws and other simple fastening devices, so it is possible to easily connect and join separate members arranged in a line or in a line spaced apart, installation is easy and the installation efficiency can be improved, and the installation cost can be reduced.

According to the 16th aspect of the invention, when installing a joint structure of upper and lower floor vertical frame members able to transmit compressive force and tensile force, since a joint fitting between members provided with joint hardware able to easily engage with the bolt shaft from the horizontal direction is used to join the upper and lower floor vertical frame members, the installation efficiency can be improved and the installation cost can be reduced.

According to the 17th aspect of the invention, at least one of the female thread fittings to be arranged at the upper floor side is attached to the bolt in the joint fitting between members and the bolt is arranged from the upper floor side to the lower floor side in the state with the female thread fitting being used to prevent the bolt from dropping to the lower floor side, so the bolt can be arranged bridging the upper and lower floors in the state not dropping to the lower floor side, therefore the work of placement of the bolt becomes easy and the subsequent attachment of the female thread fittings and other parts to the bolt, in particular, the attachment of the joint hardware from the horizontal direction, also can be easily performed so the work of joining the upper and lower floor vertical frame members can also be easily performed, the upper and lower floor vertical frame members can be efficiently joined using the joint fitting of the present invention, and the installation cost can be reduced.

BRIEF DESCRIPTION OF THE DRAWINGS

FIG. 5(*b*) is a partial horizontal cross-sectional plan view showing the relationship between a bolt and an elongated hole when providing elongated holes at upper and lower flanges.

FIG. 6(*b*) is a side view of an embodiment of a joint fitting between members used in the present invention.

FIG. 7(*b*) is a plan view of a joint fitting between members shown in FIG. 6(*a*) and FIG. 6(*b*).

FIG. 7(*c*) is a cross-sectional view along the line C-C of FIG. 6(*a*).

FIG. 8(*b*) is a front view of another embodiment of a joint fitting between members used in the present invention.

FIG. 9(*b*) is a plan view of a joint fitting between members shown in FIG. 8(*a*) and FIG. 8(*b*).

FIG. 9(*c*) is a cross-sectional view along the line D-D of FIG. 8(*a*).

FIG. 12(*b*) is a side view showing still another state of a joint fitting between members used in the present invention.

FIG. 13(*b*) is a disassembled view showing disassembled from the plan view a flat washer and U-cross-section washer and side opening groove type joint hardware in the joint fitting shown in FIG. 12(*a*) and FIG. 12(*b*).

FIG. 14(*b*) is a side view showing a joint fitting of a modification removing the flat washer from the state shown in FIG. 12(*a*) and FIG. 12(*b*).

FIG. 15(*b*) is a side view showing a joint fitting of a modification removing the U-cross-section washer from the state shown in FIG. 12(*a*) and FIG. 12(*b*).

FIG. 18(*b*) is a cross-sectional view along the line D-D of FIG. 17.

FIG. 18(*c*) is a cross-sectional view along the line E-E of FIG. 17.

BEST MODE FOR WORKING THE INVENTION

Next, the present invention will be explained in detail based on the illustrated embodiments.

Figure 6A:
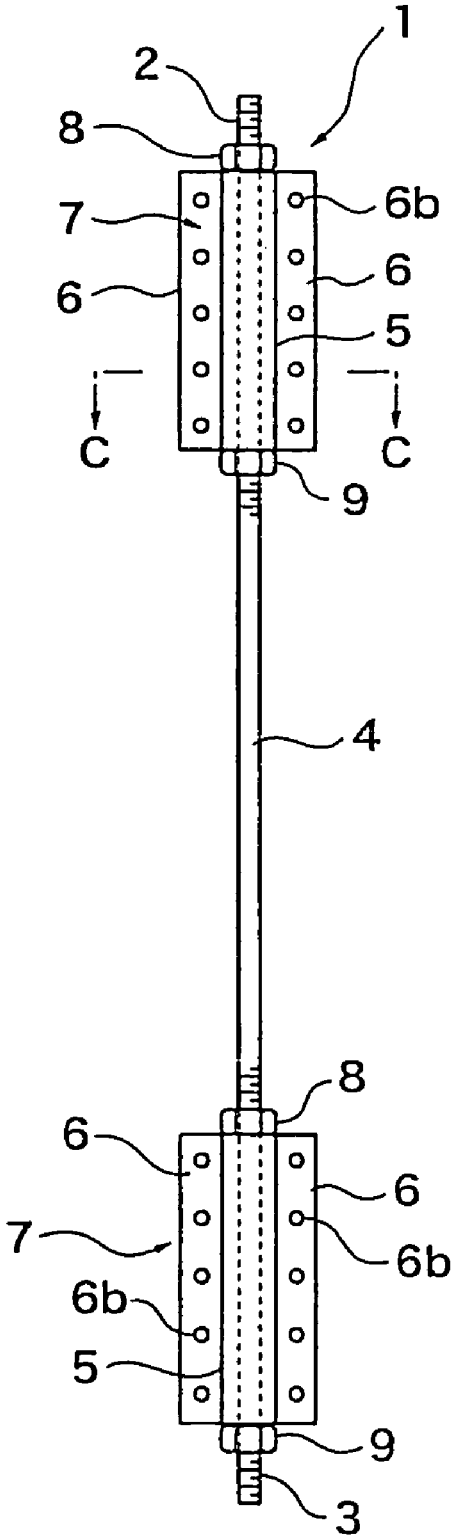
FIG. 6(*a*) is a front view of an embodiment of a joint fitting between members used in the present invention.
Figure 6B:
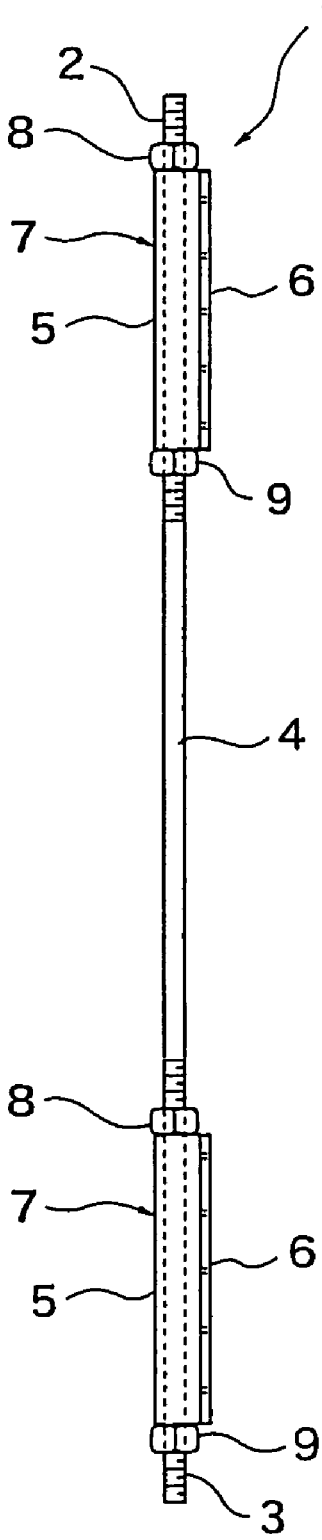
Figure 7A:
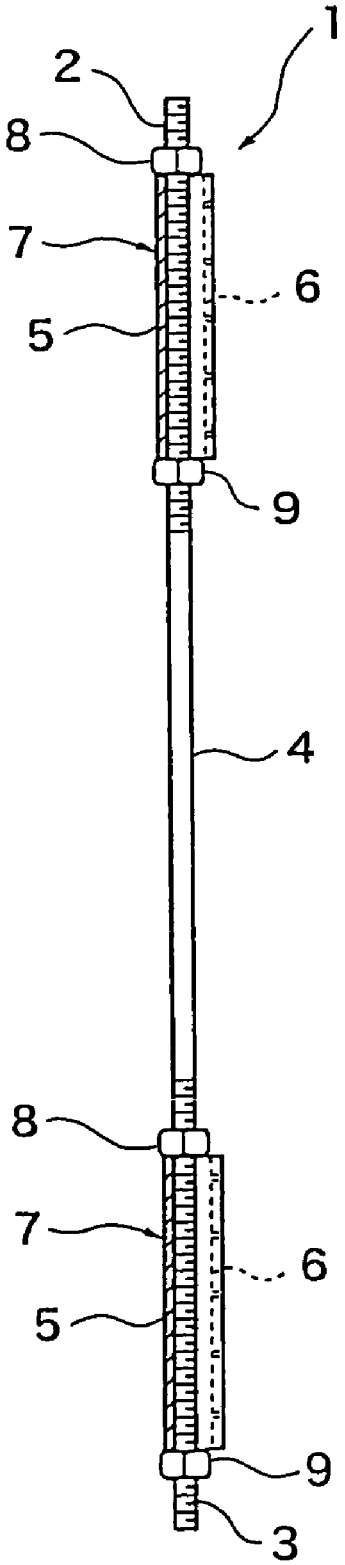
FIG. 7(*a*) is a vertical cross-sectional side view of a joint fitting between members shown in FIG. 6(*a*) and FIG. 6(*b*).
Figure 7B:
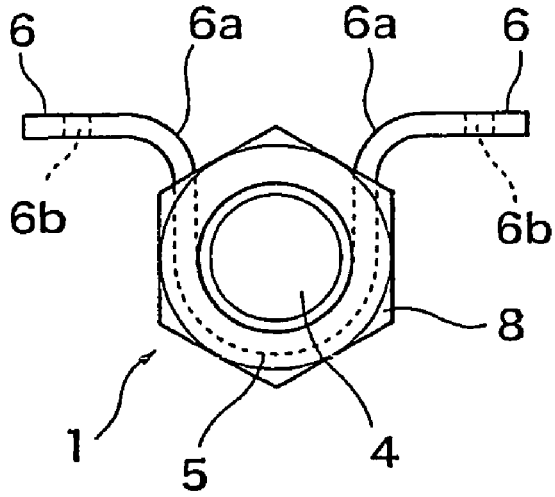
Figure 7C:
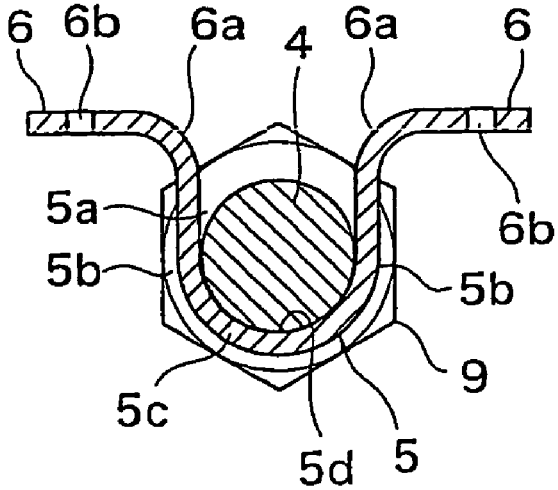

First, explaining a joint fitting between members of a first embodiment of the present invention with reference to FIG. 6(*a*), FIG. 6(*b*) and FIG. 7(*a*), FIG. 7(*b*), and FIG. 7(*c*), the illustrated joint fitting 1 between members is comprised of a single bolt having a length enabling it to be arranged vertically oriented bridging a vertical frame member of an upper floor wall panel etc. and a vertical frame member of a lower floor wall panel etc. and provided with male threaded parts 2 and 3 at its upper and lower ends in the case of constructing a building, in particular a steel house structure, and, at the two ends in the vertical direction, comprised of joint hardware 7 each comprised of a U-shaped part 5 having a continuous groove 5*a* in the vertical direction and joint flanges 6 extending in the vertical direction at the two sides, where the grooves 5*a* are engaged with the bolt 4, and the later explained female screw members 8 and 9 are fastened above and below the joint hardware 7 for fastening in position and are adjustable in position. The male threaded parts 2 and 3 at the two ends are provided at positions corresponding to the upper floor vertical frame member or lower floor vertical frame member. The screwing direction may be suitably set.

A groove 5*a* and the bolt 4 being in contact, that is, there being no gap between the inside surface of the groove 5*a* and the outside surface of the bolt 4, offset of the bolt 4 and joint hardware 7 in the horizontal direction is prevented and the joint hardware 7 or bolt 4 can be accurately positioned. This is preferable from this point.

Each joint hardware 7, in the illustrated example, for example, is comprised of rectangular steel sheet having a thickness of about 1 mm to about 3.2 mm bent to form a U-shaped part 5 formed with a groove 5*a*. Two side plates 5*b* of the U-shaped part 5 are connected through arc-shaped guides 6*a* to joint flanges 6 formed integrally with them by bending to thereby form a hat-shaped member in cross-section. Each joint flange 6 is formed at intervals in the middle in the width direction with a plurality of small sized holes 6*b* for drill screws in the vertical direction. The inside diameter of the arc-shaped inside surface 5*d* of the arc-shaped cross-section part 5*c* at the base end side of the U-shaped part 5 is set to be slightly larger than the outside diameter of the bolt 4 so that the bolt 4 and arc-shaped inside surface 5*d* are placed in proximity or in contact and thereby prevents offset of these relatively in the horizontal direction.

Figure 22:
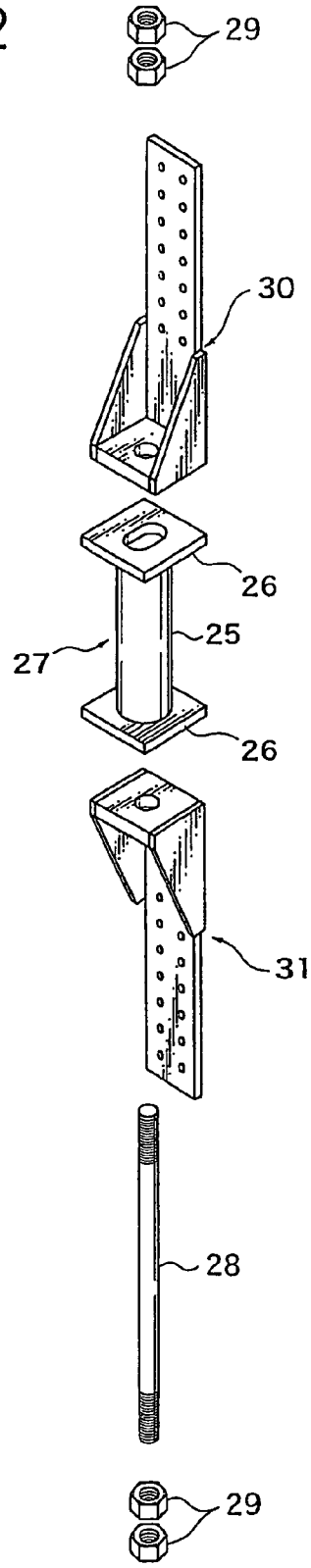
Fig.22 PRIOR ART
FIG. 22 is perspective view showing a disassembled a conventional joint fitting using hold down hardware.
Figure 23:
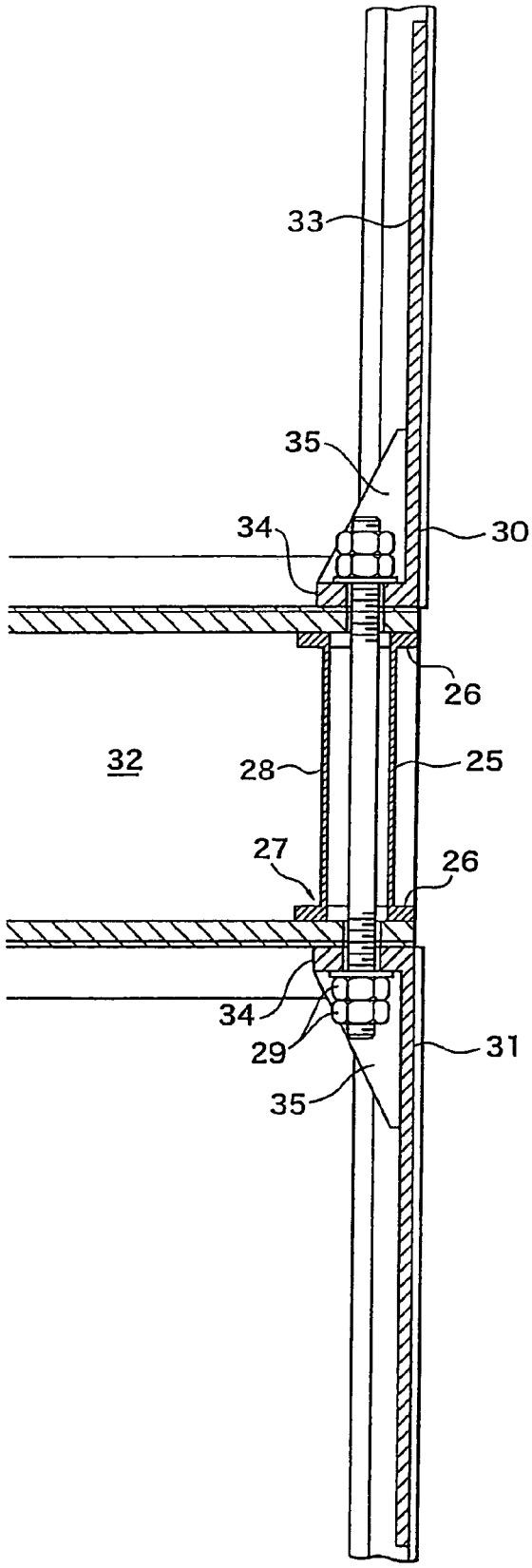
Fig. 23 PRIOR ART
FIG. 23 is a vertical cross-sectional side view showing the joint structure of upper and lower floor vertical frame members using conventional hold down hardware.

The groove 5*a* is a groove for engaging with and receiving the shaft of the bolt 4. At the two sides of the U-shaped part 5, joint flanges 6 are integrally provided. The joint flanges 6 are formed to the same planar shape. Since the joint hardware 7 is provided with joint flanges 6 at the two sides of the U-shaped part 5, in comparison to the examples shown in FIG. 22 and FIG. 23 where the conventional hold down hardware 30 and 31 are increased in thickness of the vertical parts 33 to increase the bending rigidity or the vertical parts 33 and the base parts 34 have stiffening ribs 35 welded to them perpendicularly to fasten them and increase the rigidity, it is possible to bend a single steel sheet to a hat-shape cross-section and obtain joint hardware 7 high in bending rigidity and buckling strength.

Further, due to the joint flanges 6 of the joint hardware 7, the dimension between the surfaces of the parts joined with the building side and the center axis of the bolt 4 can be shortened by at least the thickness of the vertical part 33 compared with the conventional hold down hardware 30 and 31 since, in the present invention, there is no sheet between the joint flanges 6, an ideal joint hardware 7 able to reduce the bending moment load in structure can be obtained. For this reason, it is possible to obtain a joint fitting 1 between members with little deformation of the joint hardware 7.

The upper and lower end faces of the upper and lower joint hardware 7 have pressed against them female thread fittings screwed over the bolt 4 constituted by upper surface pressing female screw members 8 made of nuts and female thread fittings constituted by lower surface pressing female screw members 9 made of nuts. The joint hardware 7 are provided to be able to be adjusted in position and to be able to be fastened in position at the top and bottom of the bolt 4. By the two side plates of the U-shaped parts 5 of the upper and lower ends of each joint hardware 7 being pressed by the pressing female screw members 8 and 9, they are joined integrally and reinforced and the tensile force and compressive force can be transmitted through the pressing female screw members 8 and 9.

For example, by loosening one of the pressing female screw members of the upper surface pressing female screw member 8 and lower surface pressing female screw member 9 and detaching it from the joint hardware 7 and, in that state, turning the other pressing female screw member, the joint hardware 7 can be adjusted in position in the vertical direction of the bolt 4. Further, by tightening the other pressing female screw member to press against the end face of the joint hardware 7, it is possible to press and fasten the upper surface pressing female screw member 8 and lower surface pressing female screw member 9 arranged above and below the joint hardware 7 against the upper and lower end faces of the joint hardware 7 and fasten the joint hardware 7 to a predetermined position in the axial direction of the bolt 4.

Figure 8A:
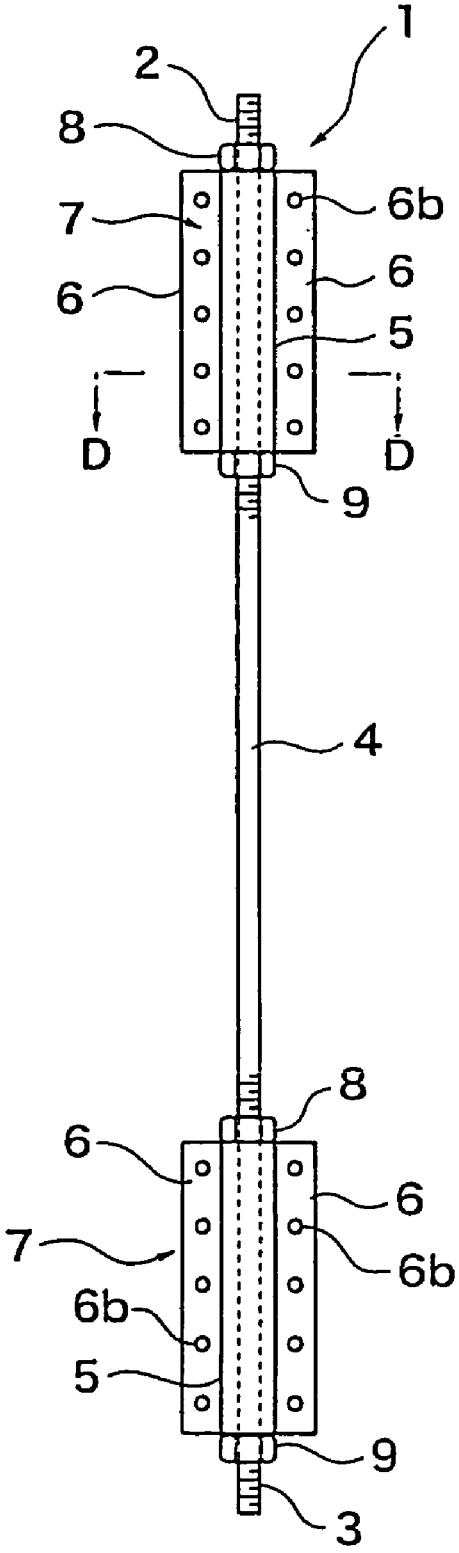
FIG. 8(*a*) is a front view of another embodiment of a joint fitting between members used in the present invention.
Figure 8B:
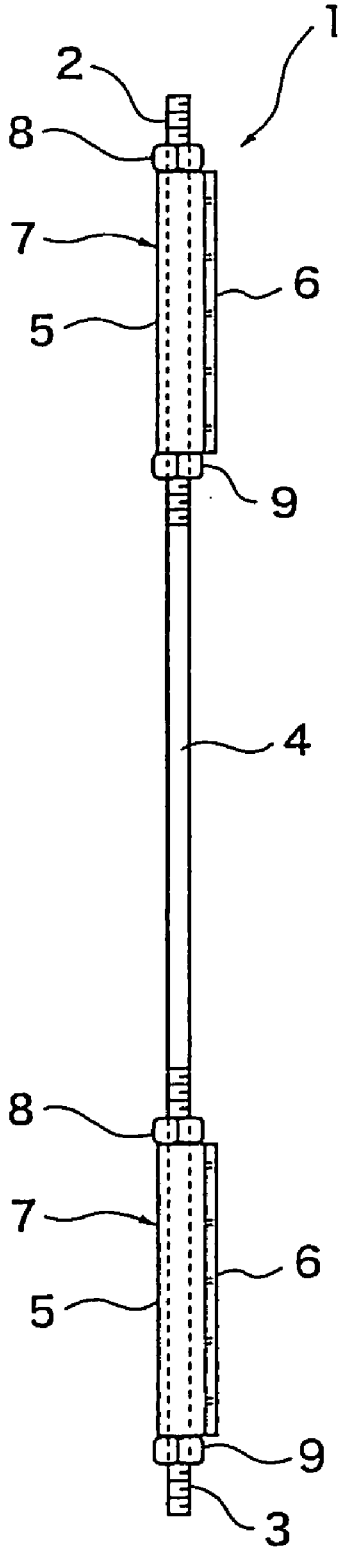
Figure 9A:
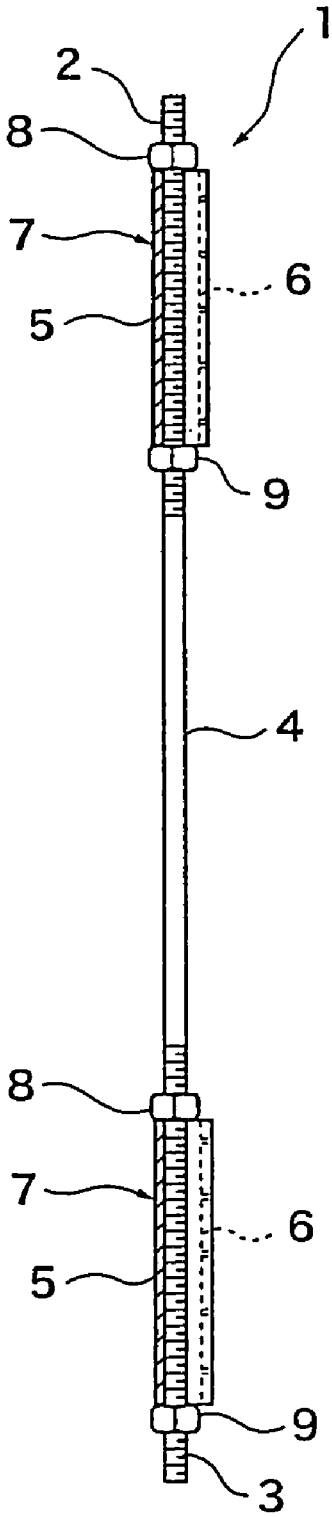
FIG. 9(*a*) is a vertical cross-sectional side view of a joint fitting between members shown in FIG. 8(*a*) and FIG. 8(*b*).
Figure 9B:
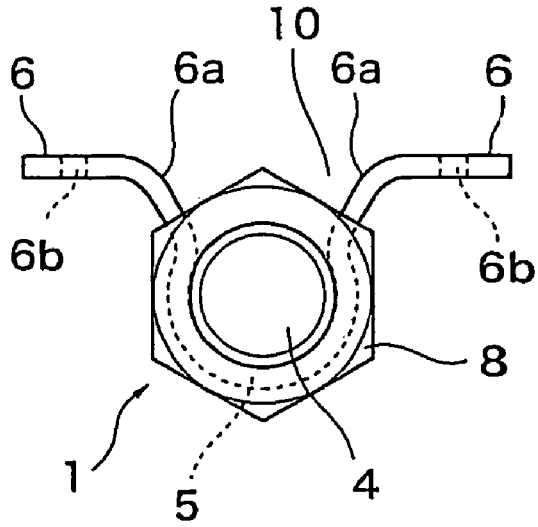
Figure 9C:
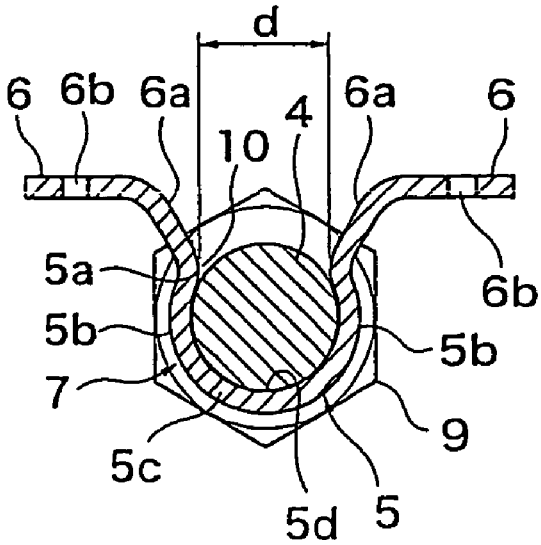

Note that as a modification of the joint fitting 1 between members, as shown in FIG. 8(*a*), FIG. 8(*b*) and FIG. 9(*a*), FIG. 9(*b*), FIG. 9(*c*), it is also possible to make the width direction between facing side plates forming the U-shaped part 5 in the joint hardware 7 partially a dimension d somewhat smaller than the outside diameter dimension of the shaft of the bolt 4. If making the side opening groove 10 one of a dimension d slightly smaller than the outside diameter dimension of the shaft of the bolt 4 in this way, it is possible to fit the shaft of the bolt 4 into the groove 5*a* to make it temporarily hold the joint hardware 7, possible to prevent the joint hardware 7 from detaching from the bolt 4 in the horizontal direction, and possible to improve the installation ability.

Figure 12A:
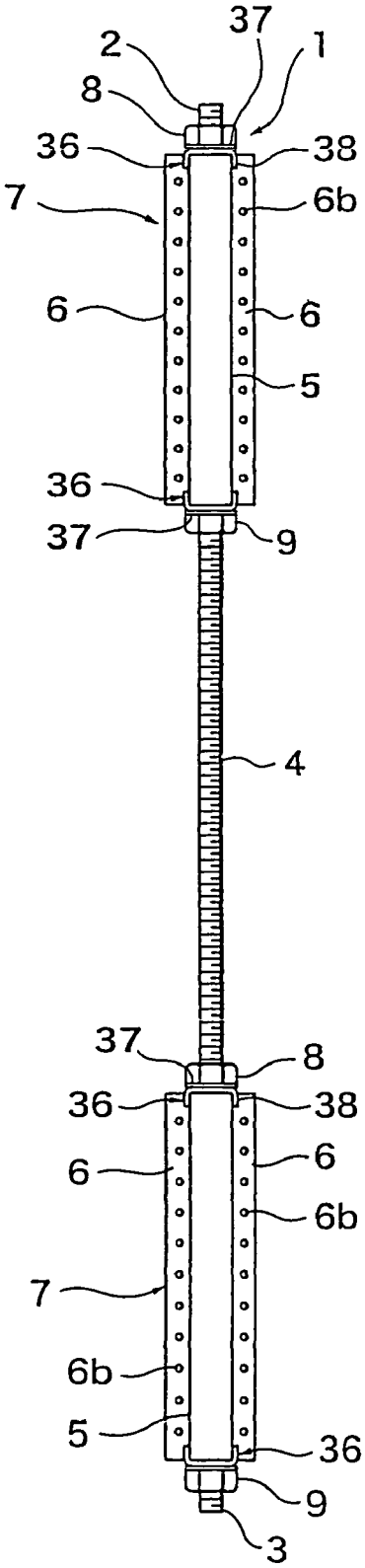
FIG. 12(*a*) is a front view showing still another state of a joint fitting between members used in the present invention.
Figure 12B:
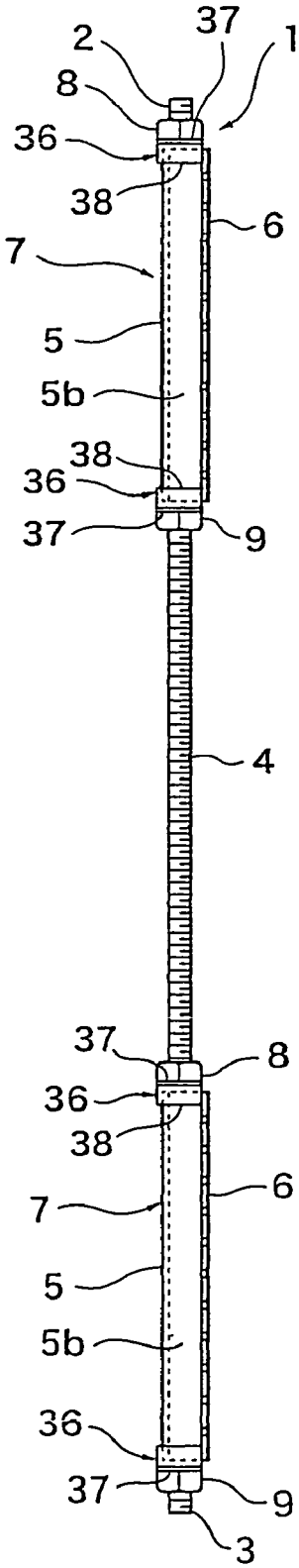
Figure 13A:
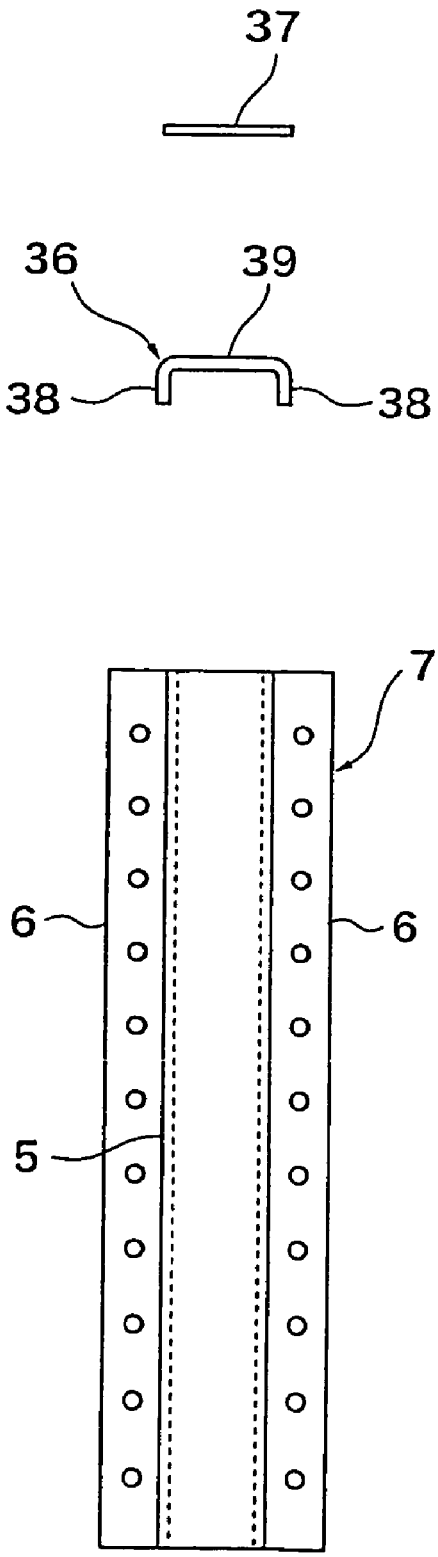
FIG. 13(*a*) is a disassembled view showing disassembled from the front view a flat washer and U-cross-section washer and side opening groove type joint hardware in the joint fitting shown in FIG. 12(*a*) and FIG. 12(*b*).
Figure 13B:
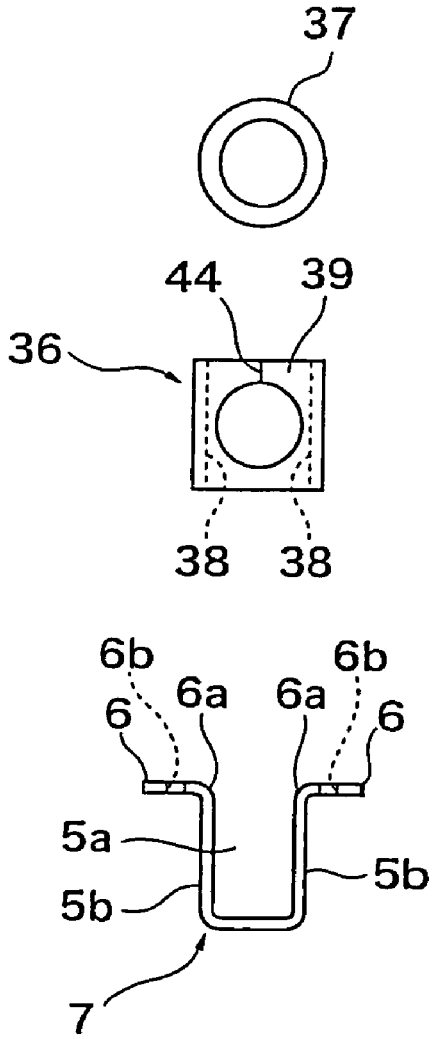

Further, as a modification of the joint fitting 1 between members, as shown in FIG. 12(*a*), FIG. 12(*b*) and FIG. 13(*a*), FIG. 13(*b*), by providing block-shaped U-shaped parts 5 having a continuous grooves 5*a* in the vertical direction with joint flanges 6 extending in the vertical direction at their two sides, engaging with the grooves 5*a* of the joint hardware 7 a bolt 4 comprised of a full threaded bolt, fitting over the bolt 4 in advance U-cross-section washers 36 and flat washers 37 outside of them so as to be positioned at the two ends of the side opening groove cross-section joint hardware 7, and pressing the flat washers 37 by the female screw members 8 and 9, it is also possible to hold the joint hardware 7 at predetermined positions through the flat washers 37 and U-cross-section washers 36.

The legs 38 of the U-cross-section washers 36 are arranged in proximity to or in contact with the outside surfaces of the side plates 5*b* of the joint hardware 7. The connecting plates 39 connecting the legs 38 are provided with bolt through holes. The provision of the flat washers 37 enables the pressing force from the female screw members 8 and 9 to be evenly dispersed and transmitted to the U-cross-section washers 36. Further, the connecting plates 39 in the U-cross-section washers 36 enable stress to be evenly dispersed to the end faces of the joint hardware 7 for fastening. Note that the connecting plates 39 are stamped with mark-off lines 44 for clarifying the positions of the connecting plates 39. The plates are set so that the mark-off line 44 sides are positioned at the flange 6 sides of the joint hardware 7.

Further, by having the legs 38 of the U-cross-section washers 36 at the different parts of the joint hardware 7 be arranged in proximity to or butting against the outside surfaces of the side plates 5*b* of the joint hardware 7, when the female screw members 8 and 9 are turned by turning tools so the female screw members 8 and 9 press against the plates, the side plates 5*b* of the joint hardware 7 are prevented from opening up to the outside opposite to the shaft side of the bolt 4 (inside surfaces) for an anti-opening action. In the embodiment shown in FIG. 6(*a*) and FIG. 6(*b*), the female screw members 8 and 9 directly butt against the end faces of the side plates 5*b* of the joint hardware 7, so when turning the female screw members 8 and 9 by turning tools to press against the joint hardware 7 end faces, a torsional moment acts on the side plates 5*a* in a direction opening them outward, so the joint hardware 7 must be increased in the rigidity of the side plates 5*b*, but with the joint hardware 7 of the embodiment shown in FIG. 12(*a*) and FIG. 12(*b*), such torsional moment can act to obtain the joint fitting 1. Note that the rest of the configuration is similar to that of the above embodiments, so similar parts are assigned similar reference numerals and explanations thereof are omitted.

Figure 14A:
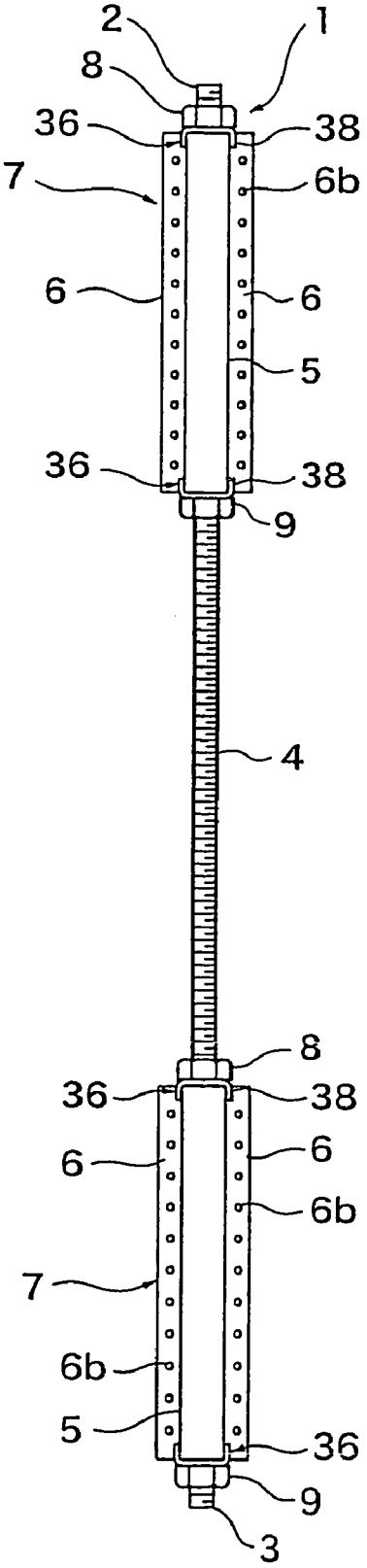
FIG. 14(*a*) is a front view showing a joint fitting of a modification removing the flat washer from the state shown in FIG. 12(*a*) and FIG. 12(*b*).
Figure 14B:
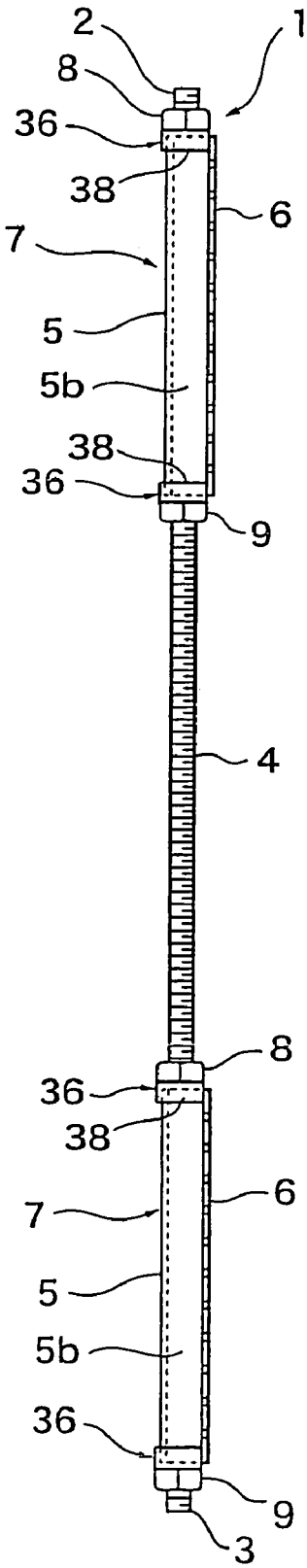

Since the joint hardware 7 is not subjected to any torsional moment in this way and a pressing force acts uniformly on the end faces of the joint hardware 7, as shown as a modification in FIG. 14(*a*) and FIG. 14(*b*), the flat washers 37 can be omitted and only the U-cross-section washers 36 used. When a pressing force acts from the connecting plates 39 of the U-cross-section washers 36 due to turning of the female screw members 8 and 9, the pressing force is evenly made to disperse to the end faces of the joint hardware 7. When a torsional moment acts due to turning of the female screw members 8 and 9, the legs 38 of the washers 36 are engaged with the outsides of the side plates 5*b* to cause a torsional moment to constantly act on the side plates 5*b* at the bolt 4 sides (inside surfaces) to thereby prevent the side plates 5*b* from opening. The rest of the configuration is similar to that of the above embodiments, so similar parts are assigned similar reference numerals and explanations thereof are omitted.

Figure 15A:
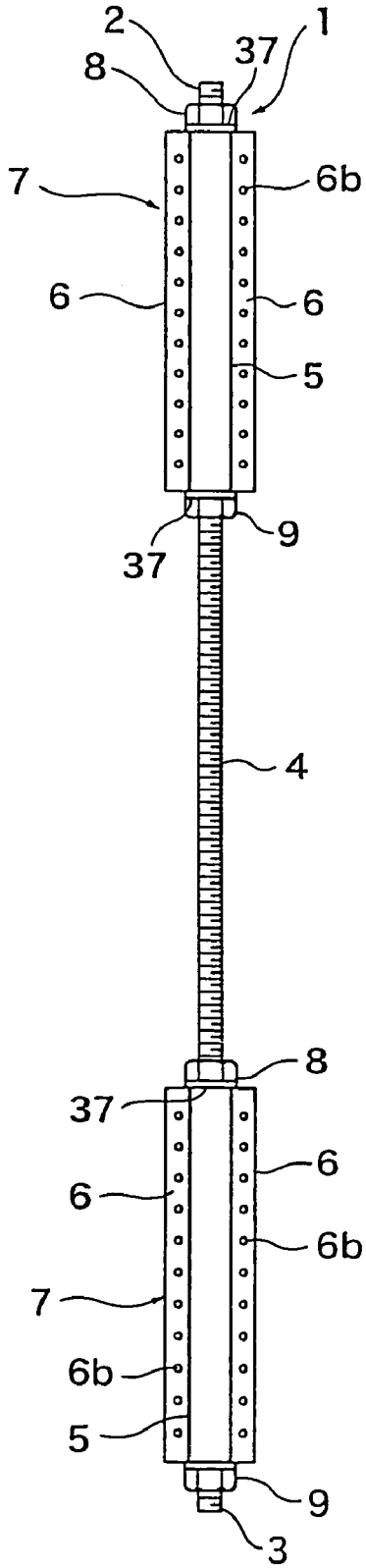
FIG. 15(*a*) is a front view showing a joint fitting of a modification removing the U-cross-section washer from the state shown in FIG. 12(*a*) and FIG. 12(*b*).
Figure 15B:
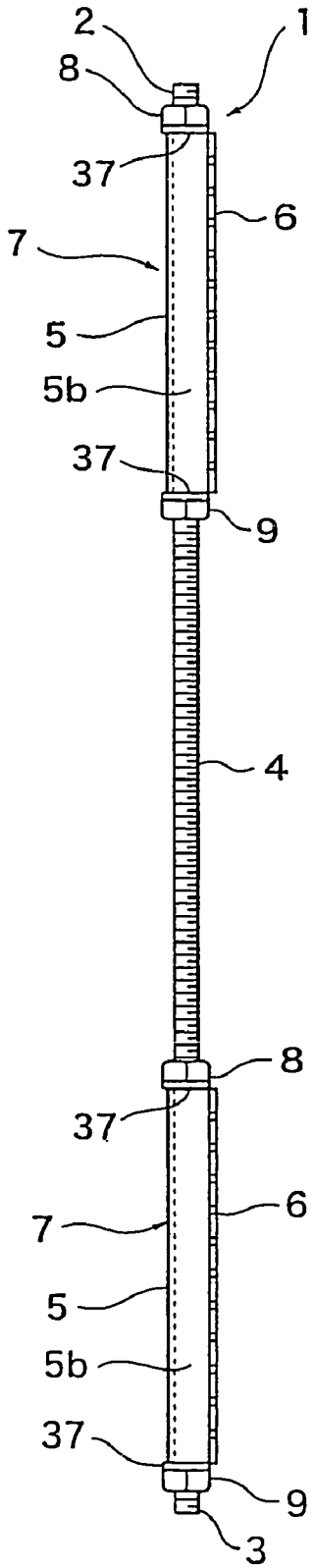

Further, as a modification of FIG. 14(*a*) and FIG. 14(*b*), as shown in FIG. 15(*a*) and FIG. 15(*b*), instead of the U-cross-section washers 36, only the flat washers 37 are used. When turning the female screw members 8 and 9 by turning tools to press against the end faces of the joint hardware 7, the flat washers 37 enable the pressing force to be evenly dispersed and transmitted to the end faces of the joint hardware 7. Further, when turning the female screw members 8 and 9 by turning tools, it is possible to reduce the torsional moment of the joint fitting 1 somewhat. The rest of the configuration is similar to that of the above embodiments, so similar parts are assigned similar reference numerals and explanations thereof are omitted. Note that in embodiments where washers are interposed, while illustration is omitted, it is also possible to further interpose spring washers outside of the U-cross-section washers 36 or flat washers 37.

In the above embodiments, when using a hexagonal head bolt as the bolt 4 in the joint fitting 1 between members, it is possible to have just one of the upper and lower joint hardware 7 be adjustable in position.

The joint fitting 1 between members of the present invention and the joint structure using that fitting, in addition to the above embodiment, while not illustrated, may also be used for connecting and joining members adjoining each other in a line in a building such as horizontal frame members, floor joints, roof truss-forming chord members, etc. In particular, with member ends adjoining each other in a line, member ends spaced apart, or member ends of roof trusses aligned tilted so as to make them line up or approach, it can be used for connecting and joining members by joining joint hardware to the member ends. The connection and joining enable transmission of compressive force or tensile force between members in the vertical direction, horizontal direction, or inclined direction. Below, however, the explanation will be given of an embodiment using the joint fitting 1 between members to join vertical frame members 11 arranged at the upper floor and lower floor with reference to FIG. 1 to FIG. 5(*a*), 5(*b*).

In the steel house structure of the illustrated embodiment, the lower floor wall panel 12 arranged and fastened at the lower floor is provided with a groove cross-section upper frame member (upper horizontal frame member) 13, a lower frame member (lower horizontal frame member, not shown) made of thin steel sheet bent to a groove shape, a vertical frame member 11 with a lip in horizontal cross-section with ends connected to these, and a thin steel sheet or other structure surface member 14 fastened by screws or drill screws or other fastening devices to one or both surfaces of the same.

Figure 10:
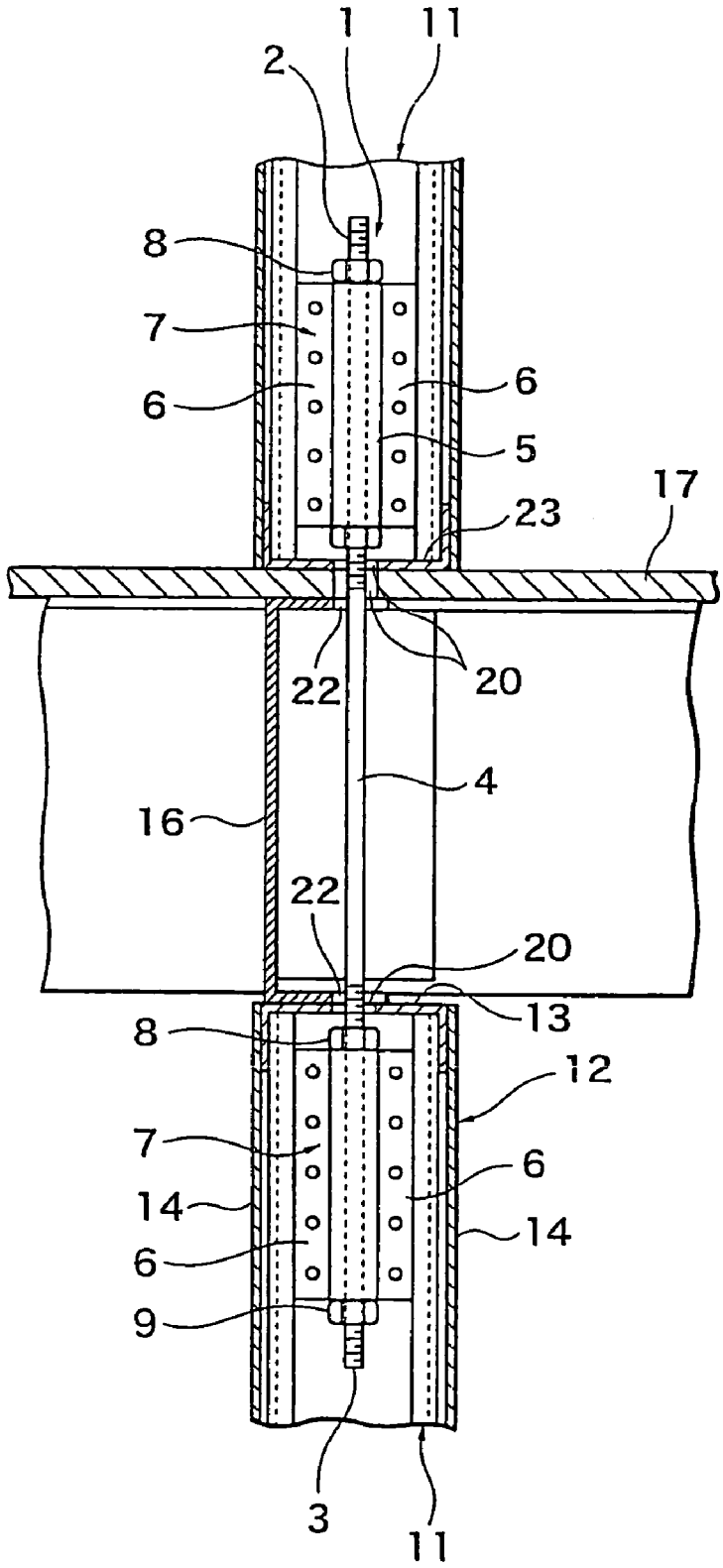
FIG. 10 is a vertical cross-sectional front view of the state of using a joint fitting between members of the present invention to join vertical frame members of upper and lower floors in a joint structure not requiring an upper frame reinforcing member.
Figure 11:
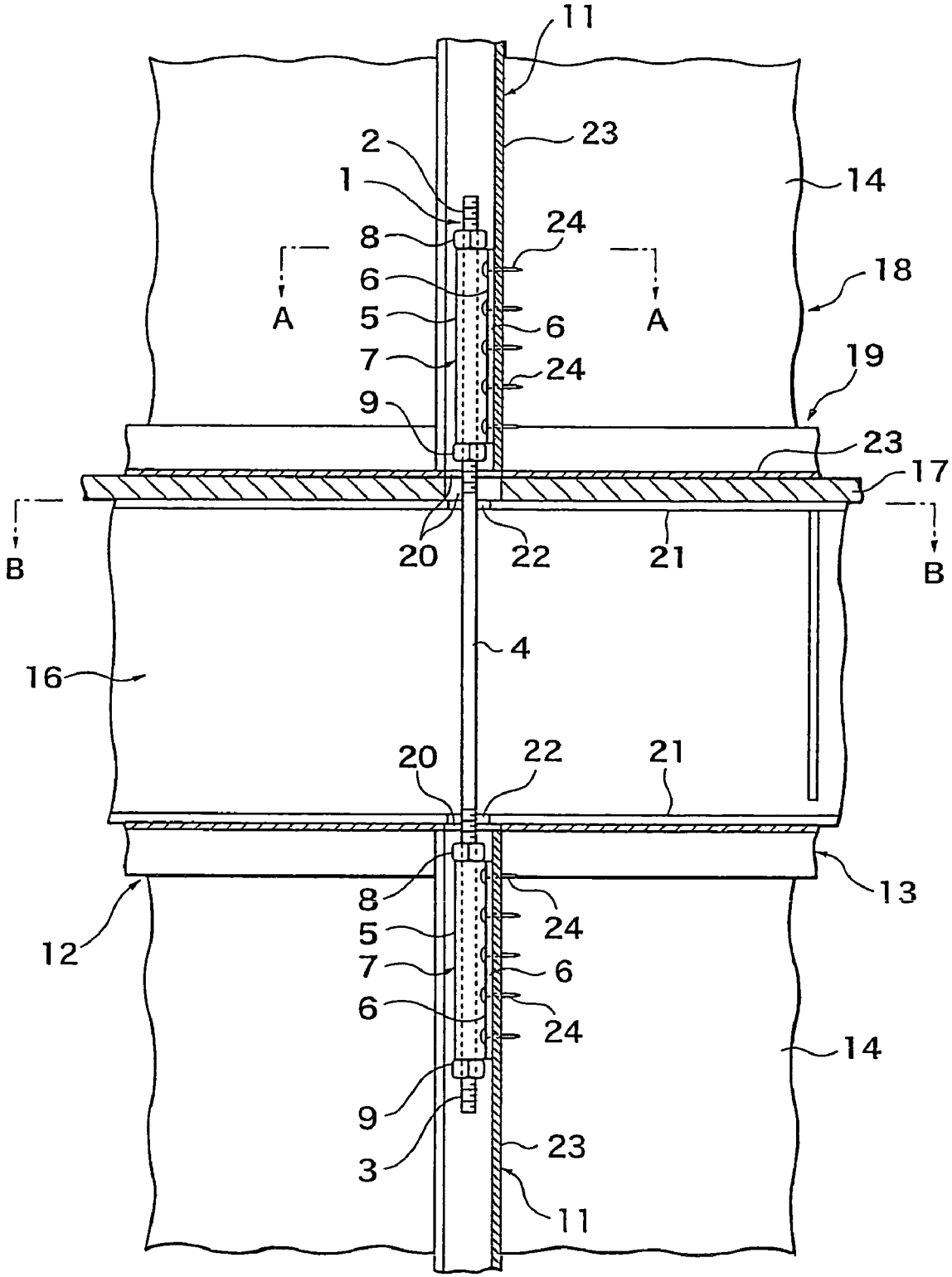
FIG. 11 is a vertical cross-sectional side view of FIG. 10.

The lower floor wall panel 12 is connected to and assembled with the foundation or a lower wall panel etc. A wood block or other upper frame reinforcing material 15 is placed along the upper frame member 13 of the lower floor wall panel 12 and fastened by drill screws or other fastening devices. An end joist or side joist 16 is arranged on the upper frame reinforcing member 15. Note that when the yield strength of the upper frame member 13 etc. is large, as shown in FIG. 10 and FIG. 11, the upper frame reinforcing member 15 is omitted and the end joist or side joist 16 is directly placed on the upper frame member 13.

The end joist or side joist 16 has a not shown floor joist or ceiling joist fastened to it, a floor sub-lining material 17 is placed on the upper flanges 21 of the end joist or side joist 16 and floor joist and fastened by drill screws or other fastening devices, an upper floor wall panel 18 of the same structure as the lower floor wall panel 12 is attached in the same vertical state as the lower floor wall panel 12 on the floor sub-lining material 17, and the web 23 of the groove cross-section lower frame member 19 at the upper floor wall panel 18 is placed on the floor sub-lining material 17 and fastened there by drill screws or other fastening devices.

Figure 1:
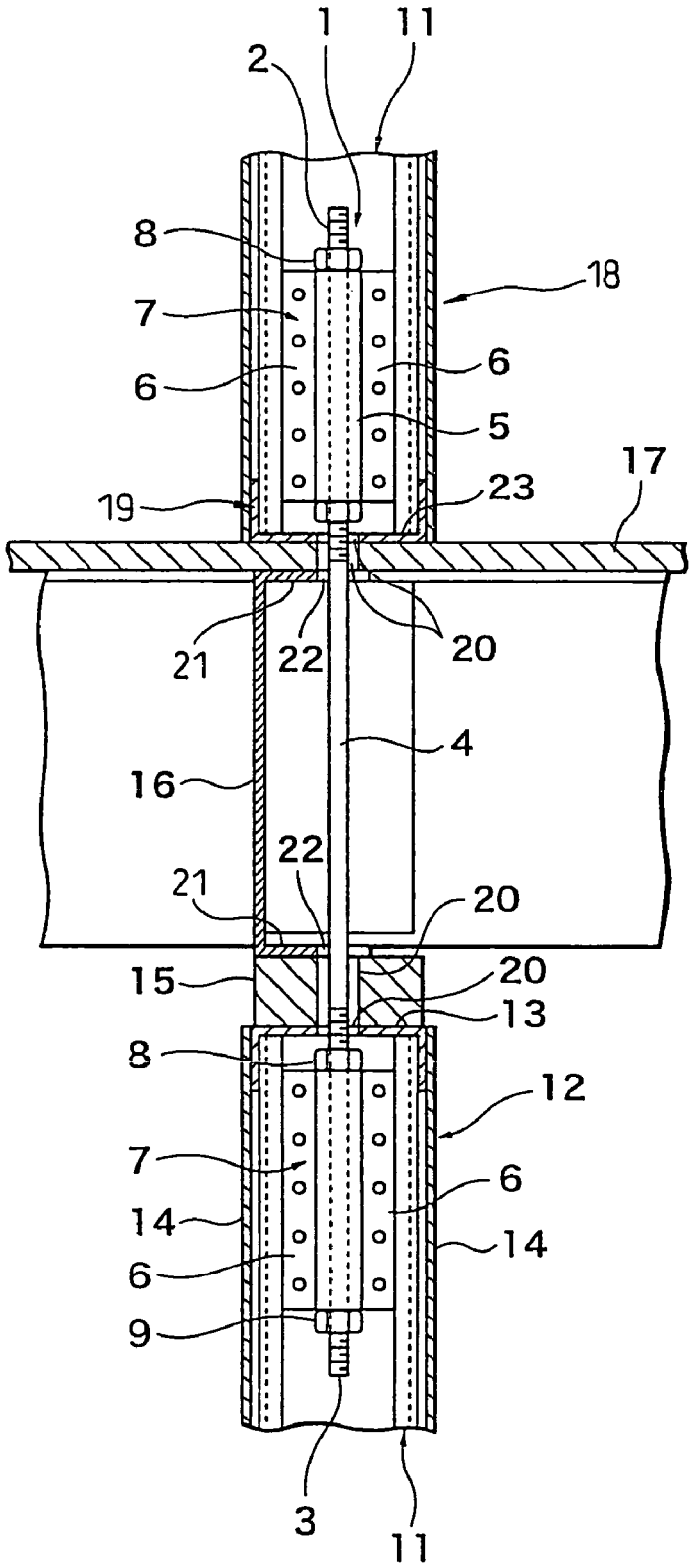
FIG. 1 is a vertical front view of the state of using a joint fitting between members of the present invention to join vertical frame members of upper and lower floors.
Figure 2:
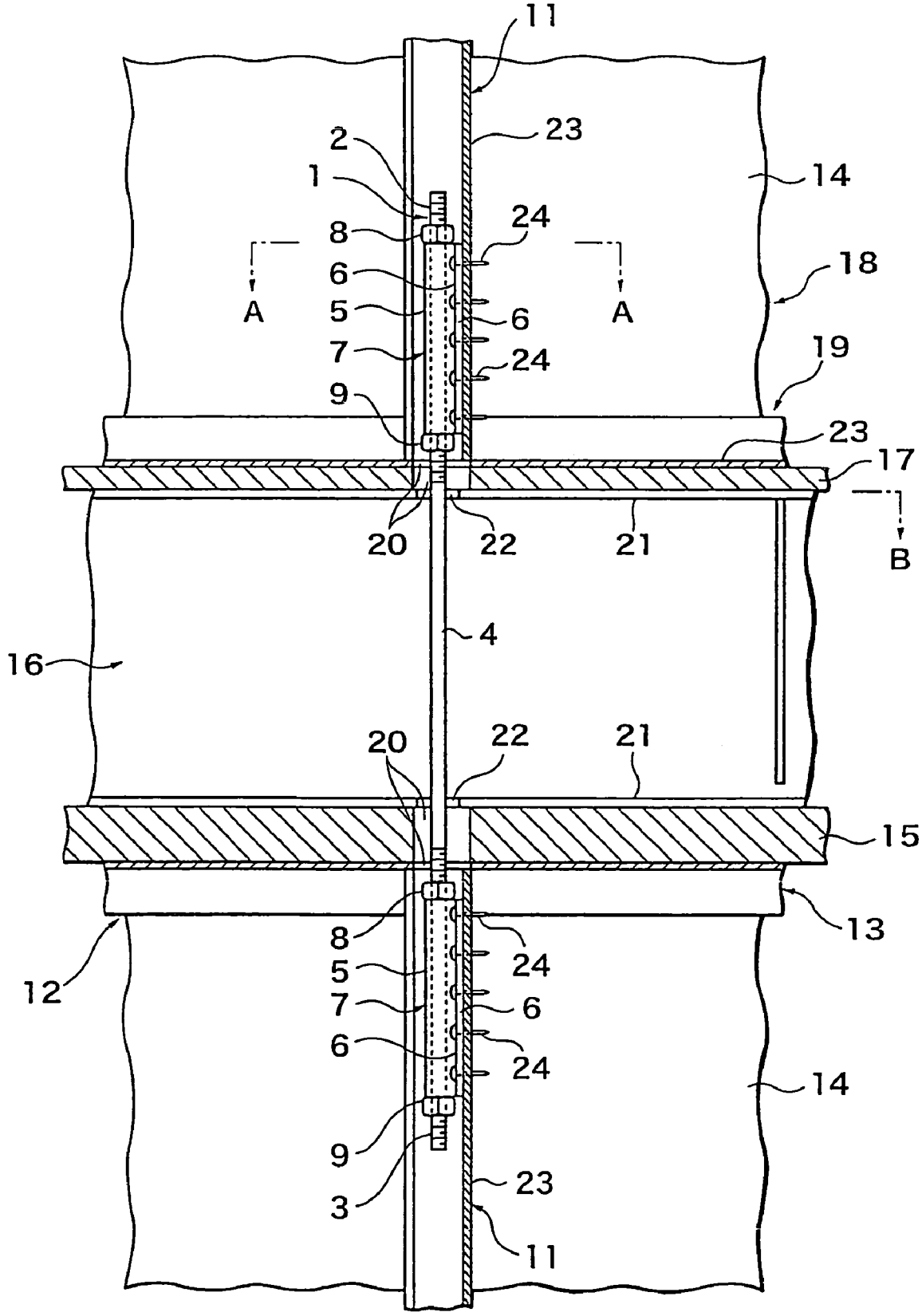
FIG. 2 is a vertical sectional side view of FIG. 1.
Figure 3:
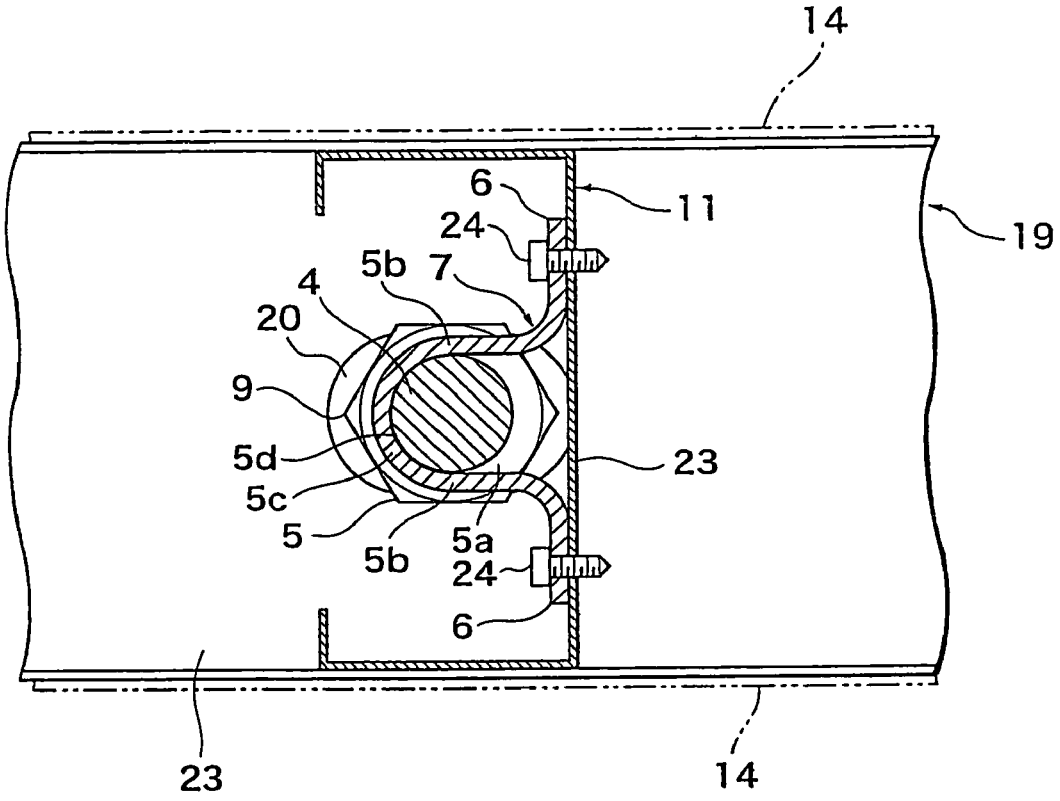
FIG. 3 is a cross-sectional view along the line A-A of FIG. 2.
Figure 4:
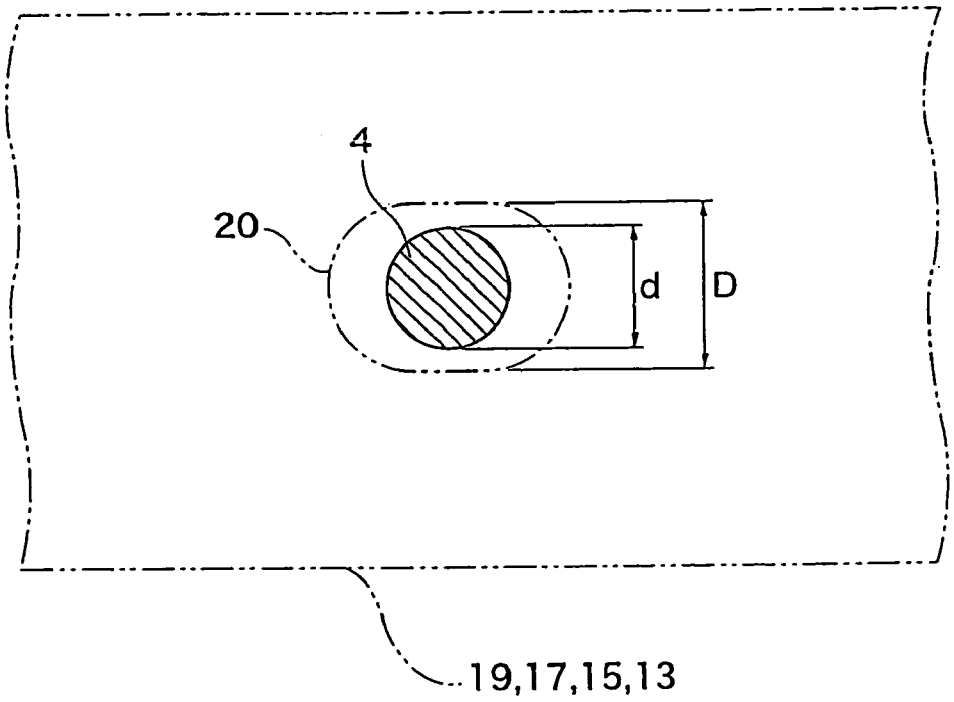
FIG. 4 is an explanatory view of the horizontal cross-section showing the relationship between a bolt shaft and a bolt through hole of each part through which the bolt shaft is passed.
Figure 5A:
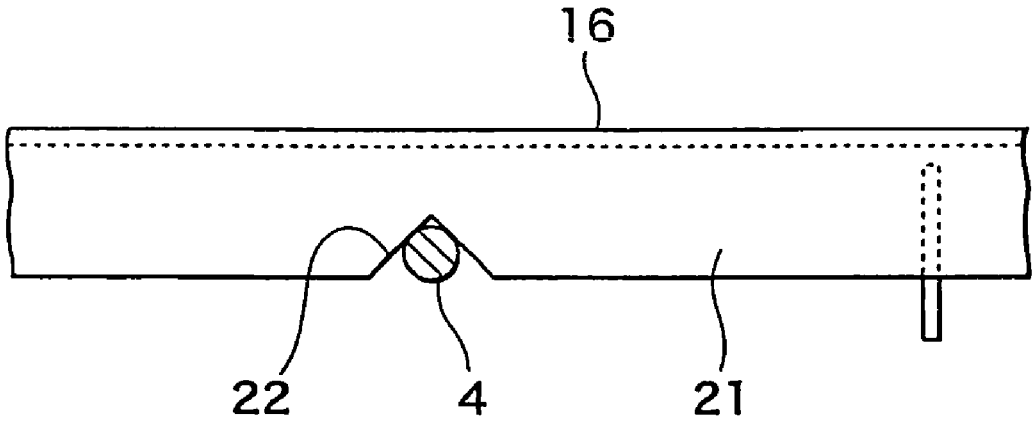
FIG. 5(*a*) is a partial horizontal cross-sectional plan view showing the relationship between a bolt and elongated hole when providing elongated holes in the upper and lower flanges.
Figure 5B:
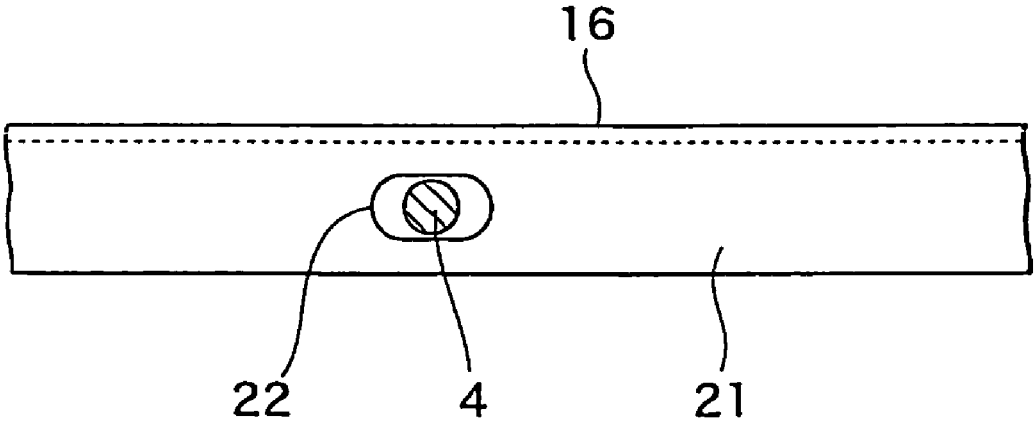

The groove cross-section lower frame member 19 in the upper floor wall panel 18 placed on the floor sub-lining material 17, the floor sub-lining material 17, the upper frame reinforcing member 15, and the upper frame member 13 in the lower floor wall panel 12, as shown FIG. 4, are provided with the elongated through holes 20 long in the member longitudinal direction superposed at the center in the member width direction. Further, the front ends of the upper and lower flanges 21 at the end joist or side joist 16 are provided with V-shaped or other notched parts 22 such as shown in FIG. 5(*a*) to prevent interference with the shaft of the bolt 4. Alternatively, when the widths of the upper and lower flanges 21 of the end joist or side joist 16 are wide, as shown in FIG. 5(*b*), holes are formed in the middle parts of the upper and lower flanges 21 in the width direction, for example, elongated holes 22 long in the member longitudinal direction are provided.

As one embodiment of the case of arranging the joint fitting 1 between members bridging the upper floor or lower floor, the bottom of the bolt 4 of the joint fitting 1 between members is inserted from the upper floor side through the elongated through holes 20 of the members (19, 17, 15, 13) in the state with the upper joint hardware 7 in the joint fitting 1 between members attached to a predetermined position of the bolt 4 and fastened in position there by the upper and lower pressing female threaded members 8 and 9 and in the state with the lower joint hardware 7 and its upper and lower pressing female threaded members 8 and 9 detached.

Further, the middle shaft of the bolt 4 is positioned at the notched parts 22 of the upper and lower flanges 21 of the end joist or side joist 16 and the joint flanges 6 of the upper floor joint hardware 7 are butted against the web 23 of the upper floor vertical frame member 11 and fastened by a suitable number of horizontally oriented fastening devices comprised of drill screws 24 or bolts or other fasteners giving the required yield strength.

Further, the upper and lower pressing female screw members 8 and 9 are screwed over the bottom of the bolt 4 arranged at the lower floor side, the joint hardware 7 are attached from the horizontal direction and fastened in position by the upper and lower pressing female screw members 8 and 9, and the joint flanges 6 are fastened to the web 23 of the vertical frame member 11 comprised of the vertical frame stud in the lower floor wall panel 12 by a suitable number of horizontally oriented fastening devices comprised drill screws 24 or bolts or other fasteners giving the necessary yield strength.

As another embodiment of the case of arranging the joint fitting 1 between members bridging the upper floor and lower floor, the top of the bolt 4 of the joint fitting 1 between members is inserted from the lower floor side through the elongated through holes 20 of the members (3, 15, 17, 19) in the state with the lower joint hardware 7 in the joint fitting 1 between members attached to a predetermined position of the bolt 4 and fastened in position there by the upper and lower pressing female threaded members 8 and 9 and in the state with the upper joint hardware 7 and its upper and lower pressing female threaded members 8 and 9 detached.

Further, the middle shaft of the bolt 4 is positioned at the notched parts 22 of the upper and lower flanges 21 of the end joist or side joist 16 and the joint flanges 6 of the lower floor joint hardware 7 are butted against the web 23 of the lower floor vertical frame member 11 and fastened by a suitable number of horizontally oriented fastening devices comprised of drill screws 24 or bolts or other fasteners giving the required yield strength.

Further, the upper and lower pressing female screw members 8 and 9 are screwed over the top of the bolt 4 arranged at the upper floor side, the joint hardware 7 are attached from the horizontal direction and fastened in position by the upper and lower pressing female screw members 8 and 9, and the joint flanges 6 are fastened to the web 23 of the vertical frame member 11 comprised of the vertical frame stud in the upper floor wall panel 12 by a suitable number of horizontally oriented fastening devices comprised drill screws 24 or bolts or other fasteners giving the necessary yield strength.

FIG. 16 to FIG. 19 show an embodiment where the joint fitting between members 1 of the embodiment shown in FIG. 12(*a*), FIG. 12(*b*) is used to join a vertical frame member 11 in a lower floor wall panel (yield strength wall) 12 and a vertical frame member 11 of an upper floor wall panel 18 through a floor panel 40. Note that, in the figure, reference numeral 41 indicates a foundation, 42 an anchor bolt, and 43 hold down hardware for integrally connecting the first floor wall panel (yield strength wall) 12 and anchor bolt 42.

Figure 16:
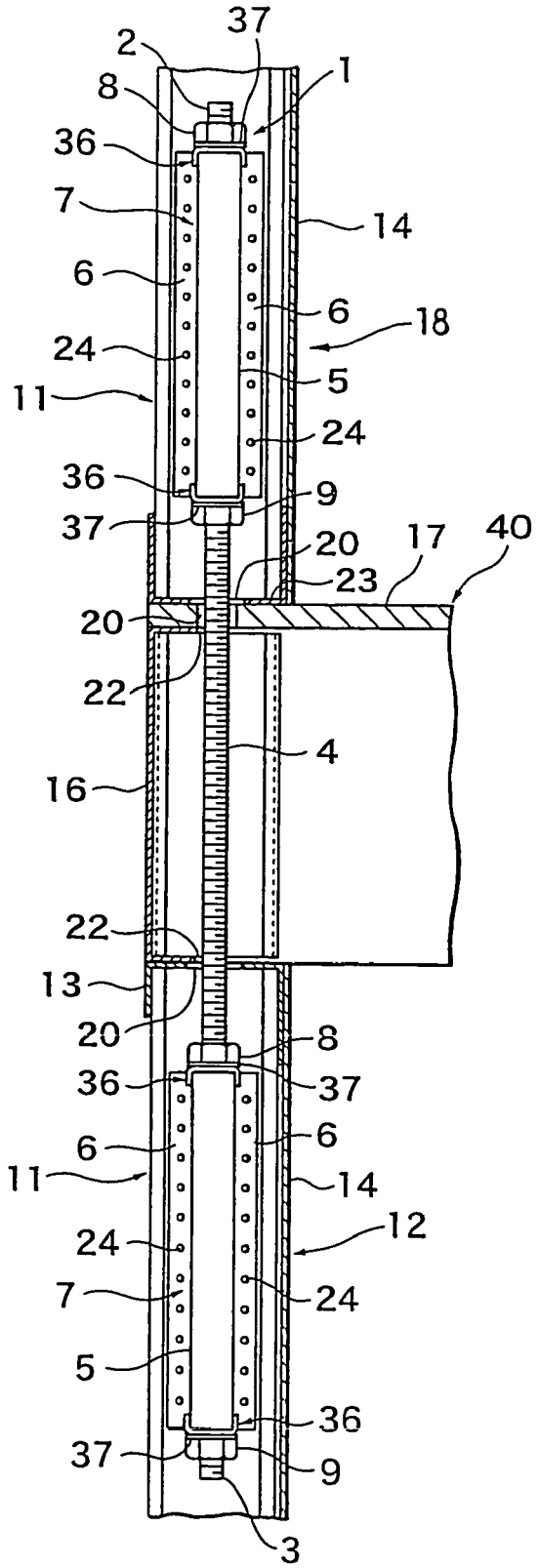
FIG. 16 is a vertical cross-sectional front view showing the state of using the joint fitting between members of the present invention shown in FIG. 12(*a*) and FIG. 12(*b*) to join upper and lower floor vertical frame members.
Figure 17:
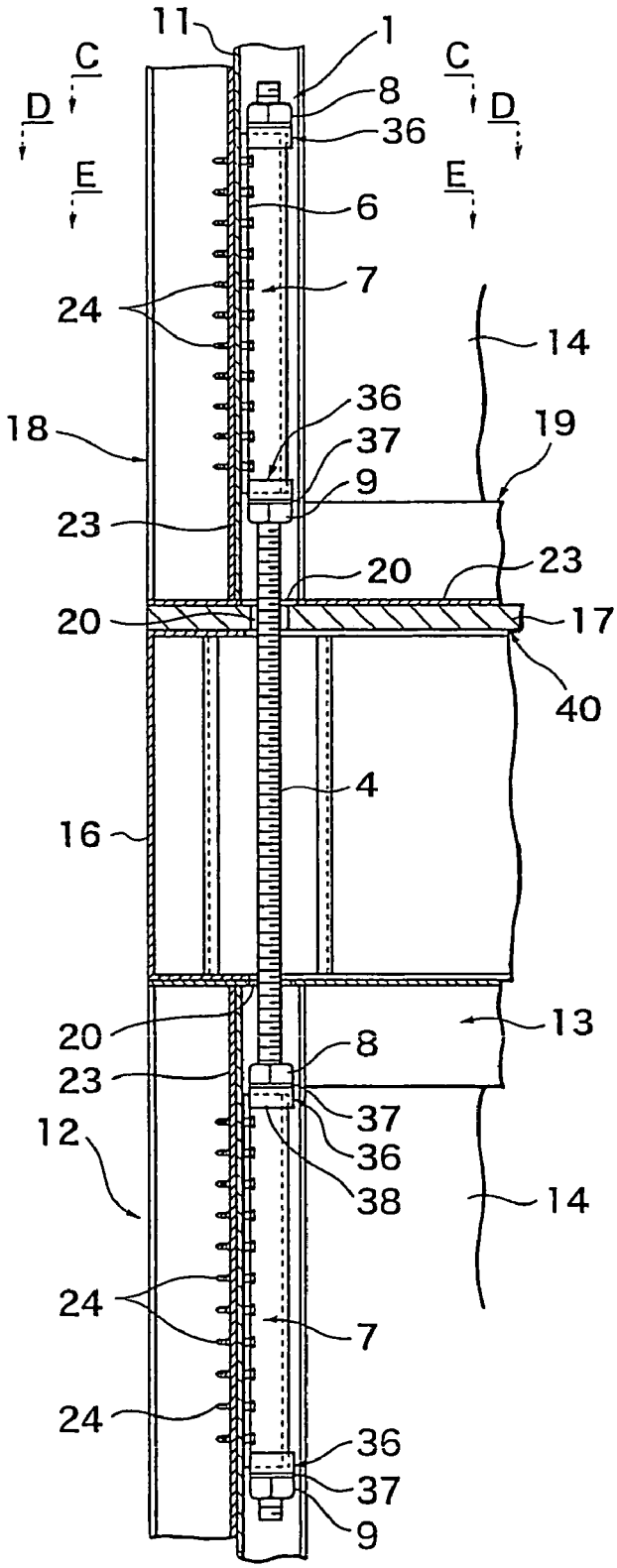
FIG. 17 is a vertical cross-sectional side view of FIG. 16.
Figure 18A:
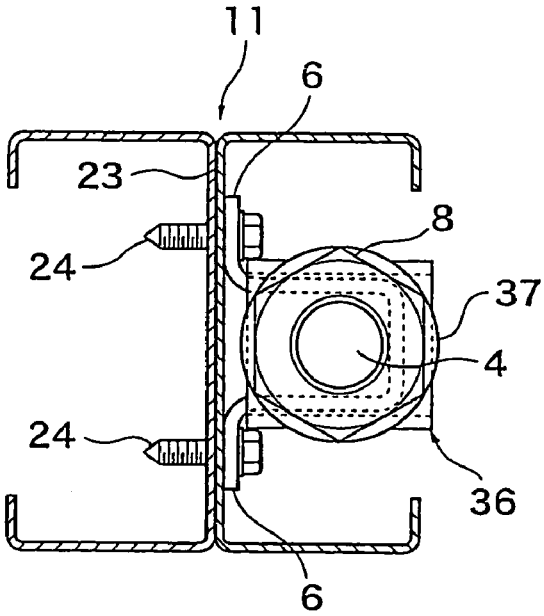
FIG. 18(*a*) is a cross-sectional view along the line C-C of FIG. 17.
Figure 18B:
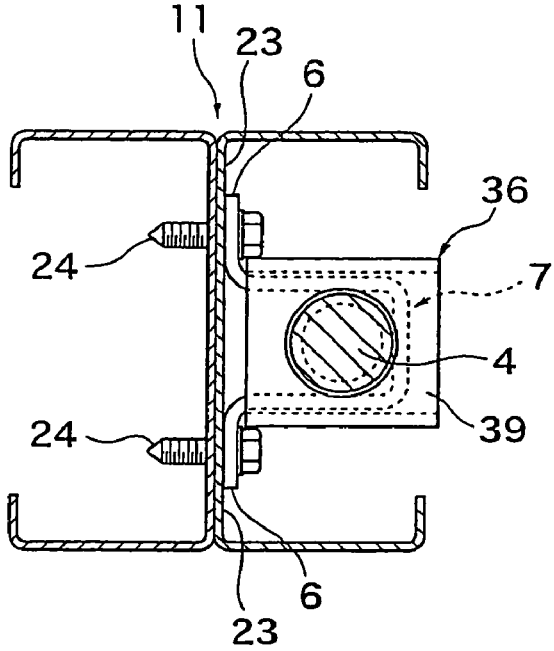
Figure 18C:
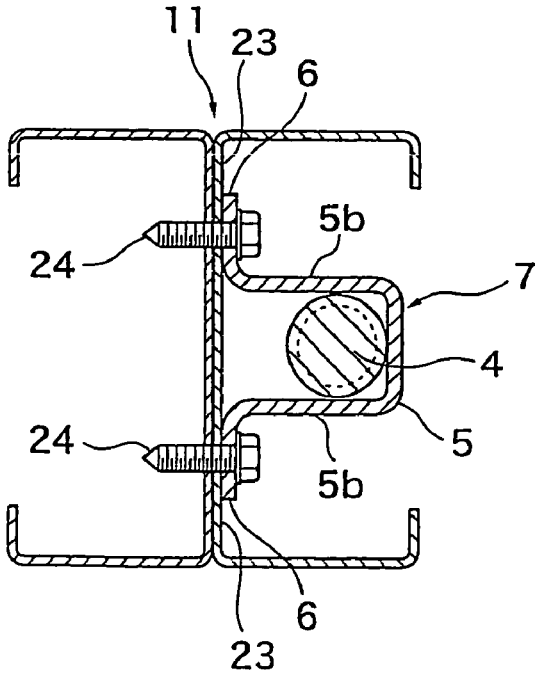

As the method for setting a joint fitting 1 between members of the present invention for joining for obtaining a joint structure of the embodiment shown in FIG. 16 to FIG. 19, the embodiment shown in FIG. 1 to FIG. 12, and the embodiment shown in FIG. 10 to FIG. 11, an embodiment of the case using the joint fitting 1 between members shown in FIG. 12(*a*), FIG. 12(*b*) as a typical embodiment and joining the vertical frame members 11 in the upper and lower floor wall panels (yield strength walls) 12 and 18 shown in FIG. 16 to FIG. 18(*a*), FIG. 18(*b*), FIG. 18(*c*) will be explained.

Figure 19:
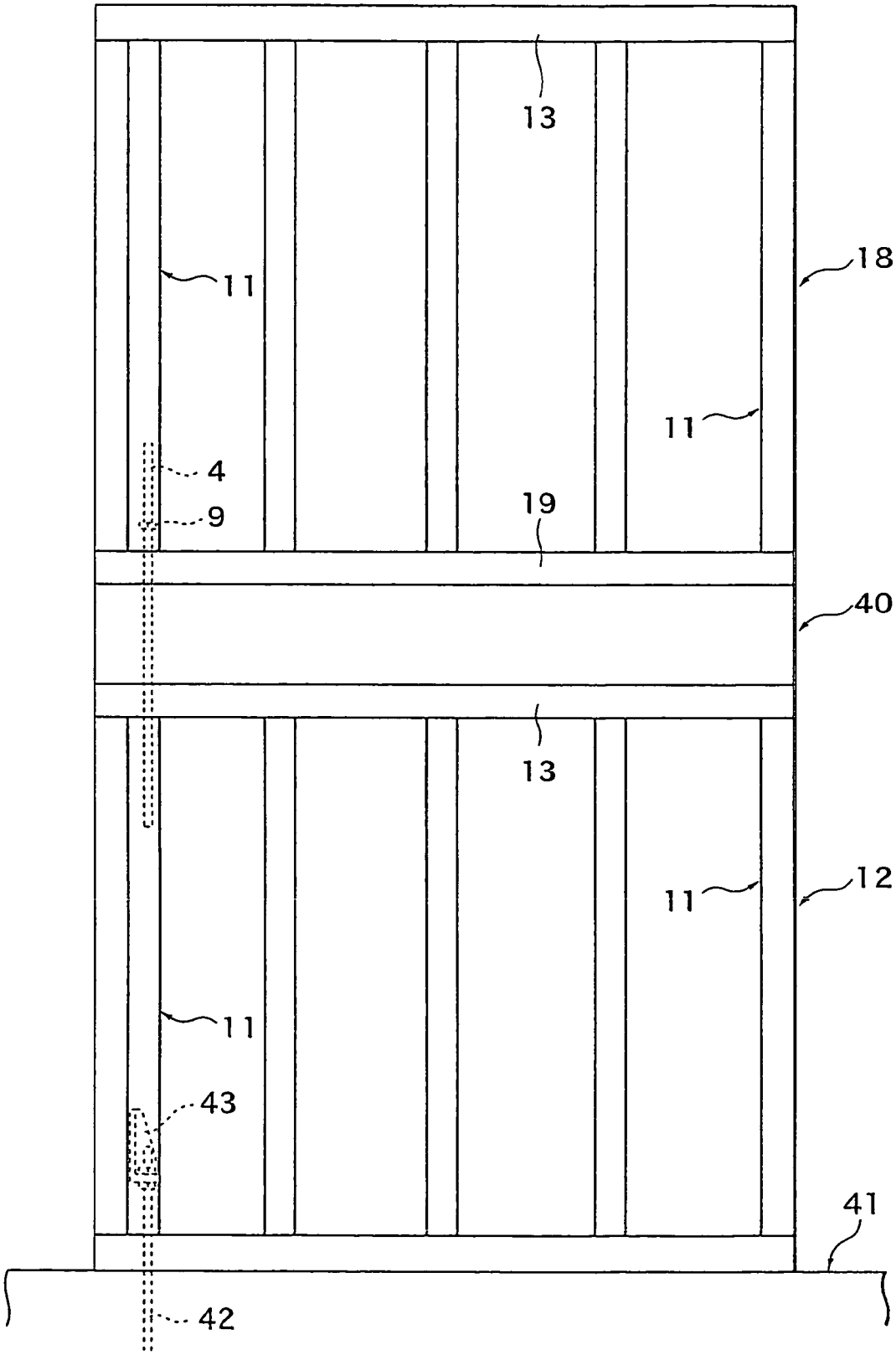
FIG. 19 is a schematic front view for explaining the joining process in the case of using a joint fitting of the present invention to join adjoining vertical frame members.
Figure 20:
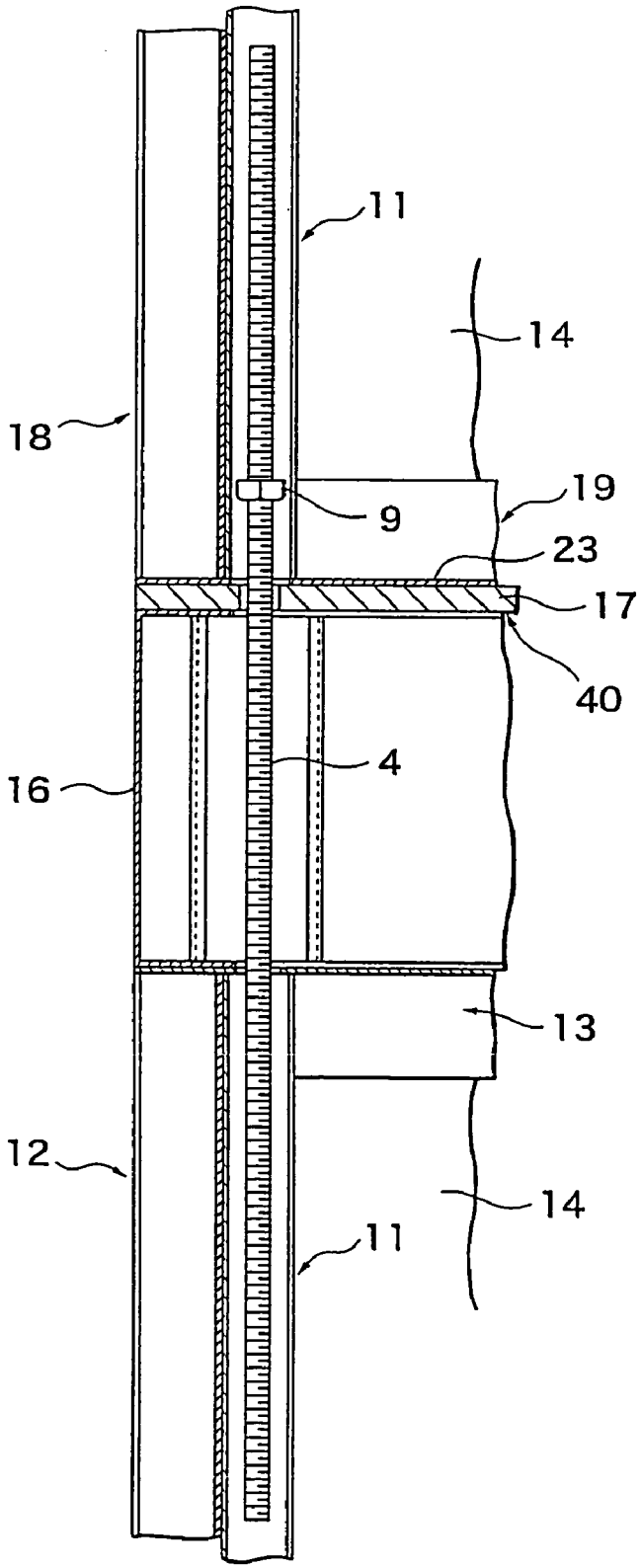
FIG. 20 is a vertical cross-sectional side view showing part of FIG. 19 enlarged.

In the joint fitting 1 shown in FIG. 12(*a*), FIG. 12(*b*), among the joint hardware 7, washers 36 and 37, and female screw members 8 and 9 attached to the bolt 4, at least the female screw member 9 below the joint hardware 7 arranged at the upper floor side is attached to obtain the bolt 4 equipped with the female screw member 9. This bolt 4 equipped with the female screw member 9, as shown in FIG. 19, is passed through the elongated hole 20 of the upper floor lower frame member 19, the elongated hole 20 of the floor sub-lining material 17 at the floor panel 40, and the notched part or elongated hole 22 of the end joist or side joist. In this case, since the female screw member 9 is larger than the holes, the bolt 4 can be prevented from dropping to the lower floor. To prevent the bolt 4 from dropping, the single female screw members 9 arranged at the upper floor side is sufficient. Parts other than this arranged at the upper floor side may also be attached.

Figure 21:
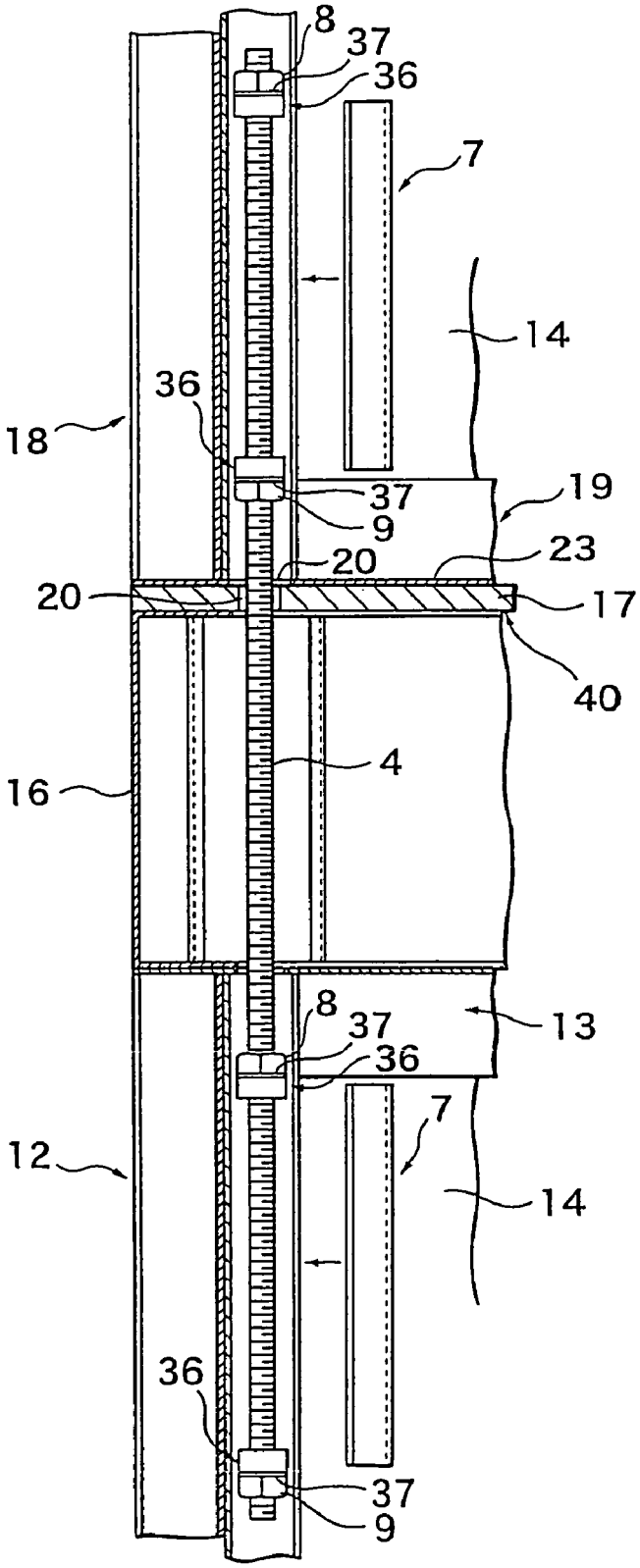
FIG. 21 is a vertical cross-sectional side view showing the state of attaching washers and female thread fittings to the bolt and finally attaching the side opening groove cross-section joint hardware to the bolt from the horizontal direction.

In the state with the bolt 4 equipped with the female screw members 9 arranged from the upper floor side to the lower floor side in this way, the bolt 4 equipped with the female screw members 9 is further successively fit with, at the shaft of the bolt 4 at the upper floor side, a flat washer 37, a pair of facing upper and lower U-cross-section washers 36, a flat washer 37, and a female screw member 8 and is further successively fit with, at the shaft of the bolt 4 at the lower floor side, a female screw member 8 and flat washer 37, a pair of upper and lower U-cross-section washers 36, and a flat washer 37 and female screw member 9 to obtain the state shown in FIG. 21.

Next, as shown in FIG. 21, at the upper floor side, in the state with the upper U-cross-section washer 36 and flat washer 37 raised up, the joint hardware 7 is fit with the bolt 4 from the horizontal direction. Further, in the same way as at the lower floor side, in the state with the upper U-cross-section washer 36 and flat washer 37 raised up, the joint hardware 7 is fit with the bolt 4 from the horizontal direction and butted against the web 23 of the vertical frame member 11. Further, the upper and lower floor female screw members 8 and 9 are turned to press against the joint hardware 7 via the washers 36 and 37 and fasten it in position. In this state, as shown in FIG. 17, drill screws 24 are used to screw the hardware into the webs 23 of the pair of vertical frame members 11 comprised of the lipped groove-shaped members overlaid with their webs 23 back to back.

By attaching at least one female thread fitting arranged at the upper floor side to the bolt 4 of the joint fitting between members and arranging the bolt from the upper floor side to the lower floor side in the state with the female thread fitting used to prevent the bolt from dropping to the lower floor side, it is possible to arrange the bolt bridging the upper and lower floors in the state not dropping to the lower floor side, so the work of placing the bolt is easy and the subsequent attachment of female thread fittings and other parts to the bolt, in particular the attachment of the joint hardware from the horizontal direction, can be easily performed, so the work of joining upper and lower floor vertical frame members can be performed easily and upper and lower floor vertical frame members can be joined efficiently using the joint fitting of the present invention.

As explained above, in the upper floor wall panel 18 and lower floor wall panel 12 connected by the joint fitting 1 between members, when an upward tensile force acts on the upper floor wall panel 18 at the time of an earthquake, wind load, etc., it is transmitted from the web 23 of the vertical frame member 11 of the upper floor wall panel 18 through the plurality of drill screws 24 or other fasteners, joint flanges 6 of the upper floor joint hardware 7, upper surface pressing female threaded member 8, bolt 4, lower floor lower surface pressing female threaded member 9, joint flanges 6 of the lower floor joint hardware 7, the plurality of drill screws 24 or other fasteners, and the web of the lower floor wall panel 12 to the lower floor wall panel 12, so it is possible to prevent the floor sub-lining material 17 and end joist or side joist 16 from being compressed.

Further, when a downward compressive force acts on the upper floor wall panel 18 at the time of an earthquake, wind load, etc., it is transmitted from the web 23 of the vertical frame member 11 of the upper floor wall panel 18 through the plurality of drill screws 24 or other fasteners, joint flanges 6 of the upper floor side joint hardware 7, lower surface pressing female threaded member 9, bolt 4, lower floor upper surface pressing female threaded member 8, joint flanges 6 of the lower floor joint hardware 7, the plurality of drill screws 24 or other fasteners, and the web of the lower floor wall panel 12 to the lower floor wall panel 12, so the floor sub-lining material 17 and end joist or side joist 16 are not compressed.

Further, when an upward force acts on the lower floor wall panel 12 at the time of an earthquake, wind load, etc., it is transmitted from the web 23 of the vertical frame member 11 of the lower floor wall panel 12 through the plurality of drill screws 24 or other fasteners, joint flanges 6 of the lower floor side joint hardware 7, upper surface pressing female threaded member 8, bolt 4, upper floor lower surface pressing female threaded member 9, joint flanges 6 of the upper floor joint hardware 7, the plurality of drill screws 24 or other fasteners, and the web of the upper floor wall panel 12 to the upper floor wall panel 18, so the floor sub-lining material 17 and end joist or side joist 16 are not compressed.

Further, when a downward compressive force acts on the lower floor wall panel 12 at the time of an earthquake, wind load, etc., it is transmitted from the web 23 of the vertical frame member 11 of the lower floor wall panel 12 through the plurality of drill screws 24 or other fasteners, joint flanges 6 of the lower floor side joint hardware 7, lower surface pressing female threaded member 9, bolt 4, upper floor upper surface pressing female threaded member 8, joint flanges 6 of the upper floor joint hardware 7, the plurality of drill screws 24 or other fasteners, and the web of the upper floor wall panel 12 to the upper floor wall panel 18, so the floor sub-lining material 17 and end joist or side joist 16 are not compressed.

When working the present invention, it is also possible to use two nuts including lock nuts as the upper surface pressing female screw member 8 and lower surface pressing female screw member 9 forming the joint fitting between members 1.

When working the present invention, the bolt 4 may also be made a bolt having male threads at the two ends in the axial direction, may have an intermediate shaft with other than a circular cross-sectional shape, and further may be a bolt provided at its two ends in the axial direction with angular lock shafts smaller than the bolt shaft in outside diameter. Further, as another embodiment of the bolt 4, it is possible to use a bolt having a hexagonal bolt head at one end in the vertical direction and having male threads at its two ends. In this case, the intermediate shaft of the bolt may be made smaller in outside diameter than the threaded parts or a fully threaded bolt may be used.

When working the present invention, the joint hardware 7 having the groove 5*a* and joint flanges 6 may also be assembled by welding a plurality of steel sheets. Note that joint hardware 7 are preferably arranged symmetrically in the vertical direction in the joint fitting 1 between members.

The invention claimed is:

1. A joint fitting between members characterized by comprising:

a single one-piece bolt having a length vertically bridging an upper floor vertical frame member having a horizontal cross section of a groove shape with lips and a lower floor vertical frame member having a horizontal cross section of a groove shape with lips at intervals along the axial direction at which bolt joint hardware being fastened to inside the grooves of the upper and lower floor vertical frame members, the joint hardware having side opening groove cross-sections, the side opening grooves in the joint hardware detachably receiving the bolt, the joint hardware being attached along the longitudinal direction of the bolt and being provided above and below thereof with upper and lower female thread fittings screwed over the bolt, the upper and lower female thread fittings clamping the joint hardware between them to hold the joint hardware at predetermined positions along the longitudinal direction of the bolt, and thereby enabling transmitting both compressive force and tensile force.

2. A joint fitting between members as set forth in claim 1, characterized in that the joint hardware is adjustable in position in the longitudinal direction of the bolt.

3. A joint fitting between members as set forth in claim 1, characterized in that the joint hardware with the side opening groove cross-sections forms a cross-sectional hat shape having joint flanges at the two sides in the horizontal direction, and the grooves of the joint hardware receives the bolt shaft.

4. A joint fitting between members as set forth in claim 1, characterized in that the grooves of the joint hardware have side opening widths slightly smaller than the outside diameter of the bolt shaft.

5. A joint fitting between members as set forth in claim 1, characterized in that the joint hardware is formed into a cross-sectional side opening groove shape by bending steel sheet.

6. A joint fitting between members as set forth in claim 1, characterized in that the joint hardware and the female thread fittings have interposed between them at least one washer passing over the bolt.

7. A joint fitting between members as set forth in claim 6, characterized in that each washer is a U-cross-section washer having legs arranged in proximity to or in contact with two side plates of the joint hardware.

8. A joint fitting between members as set forth in claim 6, characterized in that the washers include a U-cross-section washer having legs arranged in proximity to or in contact with two side plates of the joint hardware and a flat washer interposed between the U-cross-section washer and a female thread fitting.

9. A joint fitting between members as set forth in claim 1, characterized in that the female thread fittings are nuts.

10. A joint fitting between members as set forth in claim 1, characterized in that the grooves of the joint hardware receive the bolt so that its outer circumference is contacted.

11. A joint structure comprising upper and lower floor vertical frame members and the joint fitting between members of claim 1, characterized in that the joint hardware are butted against the vertical side faces of the vertical frame members of the different floors and are fastened there by fastening devices comprised of drill screws, bolts, or fasteners horizontally attaching the joint hardware to the vertical frame members.

12. A method of joining upper and lower floor vertical frame members characterized by constructing a joint structure of claim 11 by butting one joint hardware against a vertical side face of a vertical frame member of one of the upper and lower floors, fastening the joint hardware with fastening devices comprised of drill screws, bolts, or fasteners horizontally attaching the joint hardware to the vertical frame member, then butting the other joint hardware against the vertical side face of the vertical frame member at the other floor and fastening it with fastening devices comprised of drill screws, bolts, or fasteners horizontally oriented.

13. A method of joining upper and lower floor vertical frame members characterized by constructing a joint structure of claim 11 by attaching to the bolt of the joint fitting between members at least one female threaded fitting at the upper floor side, arranging the female threaded fitting to prevent the bolt from dropping to the lower floor side, then attaching the other female thread fittings to the bolt, then fitting the joint hardware of the different floors over the bolt, then butting the joint hardware against the vertical side faces of the vertical frame members and fastening them with fastening devices comprised of drill screws, bolts, or fasteners bridging horizontally oriented.

14. A joint fitting between members as set forth in claim 1, wherein the joint fitting is in a steel house structure.

* * * * *